US010871725B1

(12) United States Patent
Kuroda et al.

(10) Patent No.: US 10,871,725 B1
(45) Date of Patent: Dec. 22, 2020

(54) IMAGE FORMING APPARATUS, IMAGE FORMING METHOD AND METHOD FOR PRODUCING COLORING MEDIUM

(71) Applicant: Oki Data Corporation, Tokyo (JP)

(72) Inventors: Teruaki Kuroda, Tokyo (JP); Masahiro Kawano, Tokyo (JP); Yoshiaki Kusakabe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/878,462

(22) Filed: May 19, 2020

(30) Foreign Application Priority Data

Jun. 7, 2019 (JP) ..... 2019-106620

(51) Int. Cl.
*G03G 15/08* (2006.01)
*G03G 15/01* (2006.01)
*G03G 9/09* (2006.01)

(52) U.S. Cl.
CPC ..... *G03G 15/0121* (2013.01); *G03G 9/0926* (2013.01); *G03G 15/0152* (2013.01); *G03G 2215/00527* (2013.01)

(58) Field of Classification Search
CPC ..... G03G 15/0121; G03G 15/0152; G03G 9/0926; G03G 2215/00527
See application file for complete search history.

(56) References Cited

U.S. PATENT DOCUMENTS 4,427,412 A * 1/1984 Gorondy ..... B41M 5/0256 346/74.2
2015/0286169 A1* 10/2015 Teranishi ..... G03G 9/0926 428/195.1

FOREIGN PATENT DOCUMENTS

JP 2019-028440 A 2/2019

* cited by examiner

*Primary Examiner* — Hoang X Ngo
(74) *Attorney, Agent, or Firm* — Muncy, Geissler, Olds & Lowe, P.C.

(57) ABSTRACT

An image forming apparatus includes a first image forming part that has a first textile printing coloring material and forms a first image with the first textile printing coloring material wherein the first textile printing coloring material contains a first coloring agent that has a first sublimability; and a second image forming part that has a second textile printing coloring material and forms a second image with the second textile printing coloring material wherein the second textile printing coloring material contains a second coloring agent that has a second sublimability, which is lower than the first sublimability of the first coloring agent, wherein when the first image and the second image are superimposingly formed on a print medium, the second image is superimposingly formed over the first image.

20 Claims, 19 Drawing Sheets

Magenta

| Toner Type | Item | Heating Temp. [°C] | | | | | |
|---|---|---|---|---|---|---|---|
| | | 100 | 120 | 140 | 160 | 180 | 200 |
| M | (1) | 1.43 | 1.41 | 1.42 | 1.42 | 1.41 | 1.41 |
| | (2) | 0.24 | 0.37 | 0.63 | 0.95 | 1.16 | 1.19 |
| | (3) | 16.78 | 26.24 | 44.37 | 66.90 | 82.27 | 84.40 |
| Y | (1) | 1.39 | 1.40 | 1.38 | 1.40 | 1.40 | 1.40 |
| | (2) | 0.15 | 0.27 | 0.49 | 0.81 | 1.07 | 1.26 |
| | (3) | 10.79 | 19.29 | 35.51 | 57.86 | 76.43 | 90.00 |
| Bk | (1) | 1.41 | 1.42 | 1.42 | 1.41 | 1.40 | 1.41 |
| | (2) | 0.23 | 0.26 | 0.38 | 0.65 | 0.93 | 1.16 |
| | (3) | 16.31 | 18.31 | 28.76 | 46.10 | 66.43 | 82.27 |
| C | (1) | 1.42 | 1.42 | 1.41 | 1.43 | 1.40 | 1.44 |
| | (2) | 0.20 | 0.24 | 0.32 | 0.55 | 0.80 | 1.06 |
| | (3) | 14.08 | 16.90 | 22.70 | 38.46 | 57.14 | 73.61 |

(1) OD Value On Print Medium P
(2) OD Value On Textile Printing-Target Medium L
(3) Sublimation Transfer Efficiency (%)

*Fig. 21*
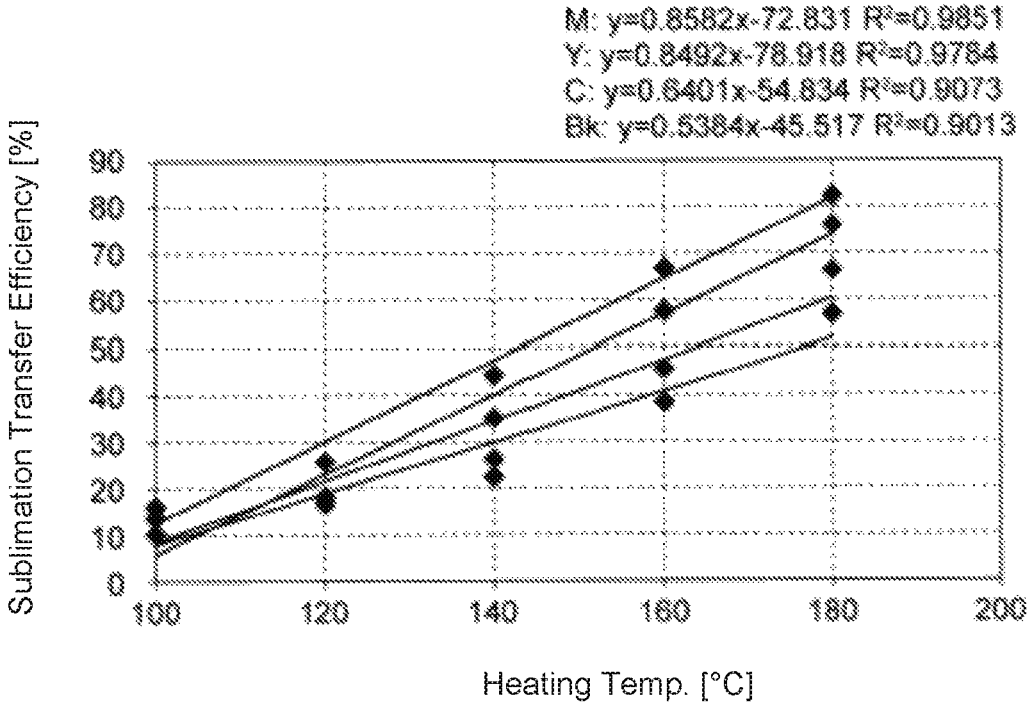
*Fig. 22*
| | Weight Reduction Start Temp [°C] | Sublimation Rate [1/°C] |
|---|---|---|
| M | 337.7 | 0.8582 |
| Y | 348.0 | 0.8492 |
| B | 357.8 | 0.6401 |
| C | 359.3 | 0.5384 |
*Fig. 23*
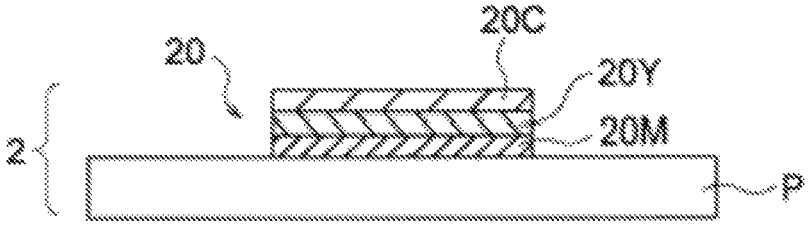

IMAGE FORMING APPARATUS, IMAGE FORMING METHOD AND METHOD FOR PRODUCING COLORING MEDIUM

TECHNICAL FIELD

The present invention relates to an image forming apparatus and an image forming method using textile printing coloring materials, and a method for producing a coloring medium.

BACKGROUND

In recent years, a technology has been developed in which an image is printed on a print medium such as a sheet of paper using textile printing coloring materials such as textile printing toners and the image is textile-printed from the medium onto a textile printing-target medium such as a cloth (for example, see Patent Document 1).

RELATED ART

Patent Document(s)

[Patent Doc. 1] JP Laid-Open Patent Application publication 2019-28440 (ABSTRACT)

ONE OBJECTIVE OF THE INVENTION

Here, when an image formed using textile printing coloring materials of multiple colors is textile-printed on a textile printing-target medium, a difference in density may occur due to a difference in sublimability between coloring agents contained in the textile printing coloring materials. As a result, a decrease in image density of one of the colors may occur, and a decrease in color reproducibility may occur.

The present invention is accomplished in order to solve the above problem, and is intended to suppress a decrease in image density during textile printing.

SUMMARY

An image forming apparatus, disclosed in the application, includes a first image forming part that has a first textile printing coloring material and forms a first image with the first textile printing coloring material wherein the first textile printing coloring material contains a first coloring agent that has a first sublimability; and a second image forming part that has a second textile printing coloring material and forms a second image with the second textile printing coloring material wherein the second textile printing coloring material contains a second coloring agent that has a second sublimability, which is lower than the first sublimability of the first coloring agent, wherein when the first image and the second image are superimposingly formed on a print medium, the second image is superimposingly formed over the first image.

In the present invention, since the second image is formed on the first image on the print medium, during textile printing from the print medium to the textile printing-target medium, the second image is positioned on the side close the textile printing-target medium. Therefore, due to the second coloring agent, migration of the first coloring agent to the textile printing-target medium can be delayed. As a result, a decrease in image density during textile printing can be suppressed, and the color reproducibility can be improved.

BRIEF DESCRIPTIONS OF THE DRAWINGS

FIG. 21 is a graph in which a relationship between the sublimation transfer efficiency and the heating temperature is shown for each of the textile printing toners of the respective colors.

FIG. 22 is a table in which a weight reduction start temperature and a sublimation rate are shown for each of the textile printing toners of the respective colors.

FIG. 23 is a schematic diagram illustrating another example of a print image on a print medium.

DETAILED DESCRIPTIONS OF THE PREFERRED EMBODIMENT(S)

In the following, an embodiment of the present invention is described with reference to the drawings. The present invention is not limited by this embodiment.

<Configuration of Image Forming Apparatus>

Figure 1:
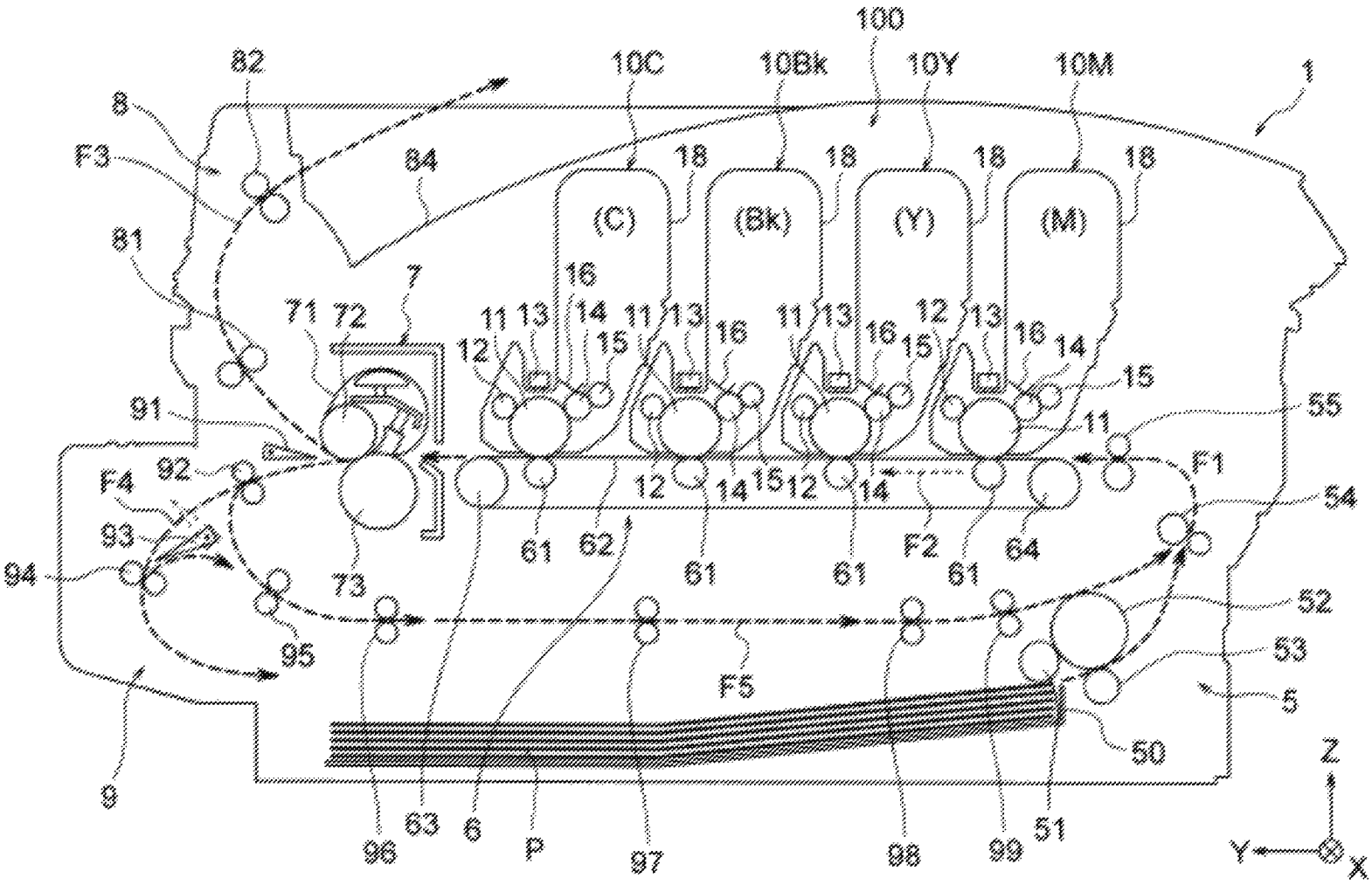
FIG. 1 illustrates an image forming apparatus of a first embodiment.

FIG. 1 illustrates an image forming apparatus 1 of a first embodiment. The image forming apparatus 1 is a printer that forms a color image using an electrophotographic method.

As illustrated in FIG. 1, the image forming apparatus 1 includes a medium supply part 5 that supplies a print medium P such as a print sheet, an image forming part 100 that forms a toner image (developer image), a transfer unit 6 that transfers the toner image formed by the image forming part 100 to the print medium P, a fuser device 7 that fuses the toner image onto the print medium P, and a medium ejection part 8 that ejects the print medium P.

The medium supply part 5 includes a sheet feeding tray 50 accommodating the print medium P, a pick-up roller 51 arranged to be in contact with the print medium P accommodated in the sheet feeding tray 50, a feed roller 52 arranged adjacent to the pickup roller 51, and a retard roller 53 arranged opposing the feed roller 52.

The sheet feeding tray 50 accommodates the print medium P such as a print sheet in a stacked state. The pickup roller 51 is in contact with the print medium P in the sheet feeding tray 50, and rotates, and feeds out the print medium P from the sheet feeding tray 50. The feed roller 52 feeds the print medium P fed out by the pickup roller 51 to a carrying path F1. The retard roller 53 rotates in a direction opposite to a feeding direction of the feed roller 52, and prevents double feeding by applying a carrying resistance to the print medium P.

The medium supply part 5 further includes a registration roller pair 54 and a carrying roller pair 55 arranged along the carrying path F1 of the print medium P. The registration roller pair 54 includes a pair of rollers that are in contact with each other, and starts rotating at a predetermined timing after a leading edge of the print medium P is in contact with nip parts of the two roller, and thereby, corrects a skew of the print medium P and carries the print medium P. The carrying roller pair 55 includes a pair of rollers that are in contact with each other, and carries the print medium P from the registration roller pair 54 to the image forming part 100.

The image forming part 100 has four process units 10M, 10Y, 10Bk, 10C as image forming units that respectively form toner images using magenta, yellow, black and cyan textile printing toners (textile printing coloring materials: developers). The process units 10M, 10Y, 10Bk, 10C are arranged in this order along a carrying direction (from right to left in FIG. 1) of the print medium P.

The process unit 10M (first image forming unit) forms a magenta image (first image) using a textile printing magenta toner (first textile printing coloring material). The process unit 10Y (third image forming unit) forms a yellow image (third image) using a textile printing yellow toner (third textile printing coloring material). The process unit 10K (fourth image forming unit) forms a black image (fourth image) using a textile printing black toner (fourth textile printing coloring material). The process unit 10C (second image forming unit) forms a cyan image (second image) using a textile printing cyan toner (second textile printing coloring material).

Here, the four process units 10M, 10Y, 10Bk, and 10C are provided. However, the number of the process units 10 is not limited as long as the number is two or more. Further, the arrangement of the process units 10M, 10Y, 10Bk, and 10C is not limited to the arrangement illustrated in FIG. 1 (see FIGS. 25 and 26 to be described later).

The process units 10M, 10Y, 10Bk, 10C are referred to as "process units 10" when it is not necessary to particularly distinguish between them.

The process units 10 each include a photosensitive drum 11 as an image carrier carrying a toner image, a charging roller 12 as a charging member, a development roller 14 as a developer carrier, a supply roller 15 as a supply member, and a development blade 16 as developer regulating member. Further, a print head 13 as an exposure device is arranged opposing the photosensitive drum 11.

Figure 2:
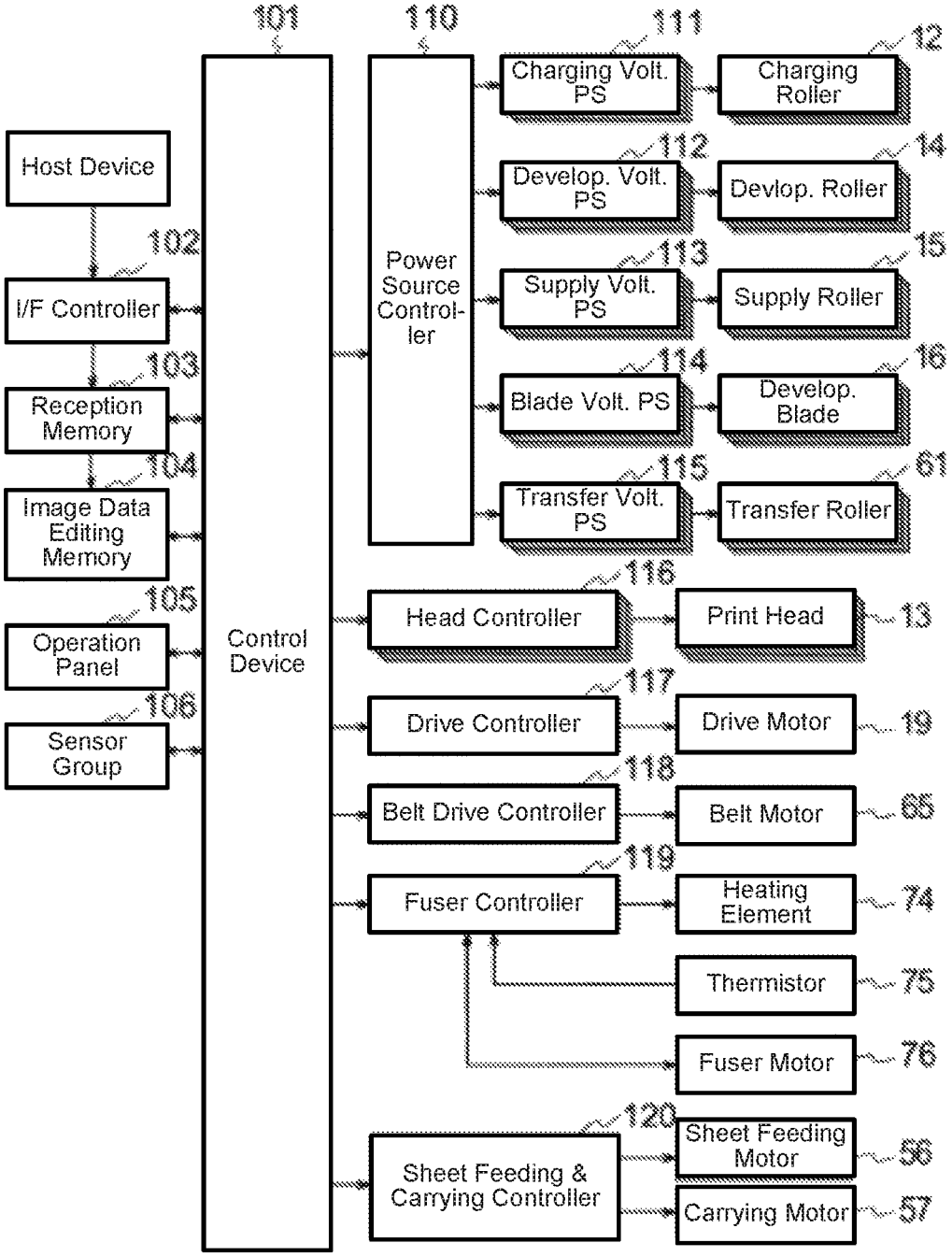
FIG. 2 is a block diagram illustrating a control system of the image forming apparatus of the first embodiment.

The photosensitive drum 11 has a cylindrical conductive supporting body and a photosensitive layer formed on a surface (outer peripheral surface) of the conductive supporting body. The conductive supporting body is formed of, for example, a metal such as aluminum, an aluminum alloy, stainless steel, copper, or nickel, or a resin to which a conductive powder (for example, metal, carbon or tin oxide) is added. The photosensitive drum 11 is rotated clockwise in the drawing by a drive motor 19 (FIG. 2).

The charging roller 12 is provided in contact with a surface of the photosensitive drum 11, and rotates following the rotation of the photosensitive drum 11. The charging roller 12 is formed, for example, by forming a semiconductive epichlorohydrin rubber layer on a surface of a metal shaft. The charging roller 12 is applied with a charging voltage by a charging voltage power source 111 (FIG. 2) and uniformly charges the surface of the photosensitive drum 11.

The print head 13 has a light emitting element array in which multiple LEDs (light emitting diodes) are arranged in one direction, and a lens array in which multiple lenses are arranged in one direction. The print head 13 is arranged such that light of the LEDs is focused on the surface of the photosensitive drum 11 by the lenses. The print head 13 is driven by a head controller 116 (FIG. 2) and exposes the surface of the photosensitive drum 11 to form an electrostatic latent image.

The development roller 14 is provided in contact with the surface of the photosensitive drum 11 and rotates in a direction opposite to the rotation direction of the photosensitive drum 11 (that is, movement directions of the surfaces at an opposing part between the development roller 14 and the photosensitive drum 11 are forward directions). The development roller 14 is formed, for example, by forming a semiconductive urethane rubber layer on a surface of a metal shaft. The development roller 14 is applied with a development voltage by a development voltage power source 112 (FIG. 2), and develops the electrostatic latent image on the surface of the photosensitive drum 11.

The supply roller 15 is provided in contact with a surface of the development roller 14, and rotates in the same direction as the rotation direction of the development roller 14 (that is, movement directions of the surfaces at an opposing part between the supply roller 15 and the development roller 14 are opposite directions). The supply roller 15 is formed, for example, by forming a semiconductive urethane rubber layer on a surface of a metal shaft. The supply roller 15 is applied with a supply voltage by a supply voltage power source 113 (FIG. 2), and supplies a toner to the development roller 14.

The development blade 16 is formed, for example, by bending a long plate-like member formed of metal such as stainless steel such that a cross section thereof orthogonal to a longitudinal direction has a substantially L-shape. The development blade 16 is arranged such that an outer surface of a bent portion thereof is in contact with the surface of the development roller 14. The development blade 16 is applied with a blade voltage by a blade voltage power source 114 (FIG. 2), and regulates a thickness and a charge amount of a toner layer on the development roller 14.

In each of the process units 10, a portion including the development roller 14, the supply roller 15 and the development blade 16, that is, a portion that contributes to the development of the electrostatic latent image, forms a development part. Above the development part of each of the process units 10 (+Z), a toner cartridge 18 as a developer container is detachably attached. The toner cartridge 18 contains a textile printing toner and supplies the textile printing toner to the development part.

The transfer unit 6 includes an endless transfer belt 62, a belt drive roller 63 and an idle roller 64 over which the transfer belt 62 is stretched, and transfer rollers 61 as transfer members that are respectively arranged opposing the photosensitive drums 11 of the process units 10M, 10Y, 10Bk, 10C via the transfer belt 62.

The transfer rollers 61 are provided such that the transfer belt 62 is sandwiched between the transfer rollers 61 and the photosensitive drums 11, and respectively rotate following the rotations of the photosensitive drums 11. The transfer rollers 61 are each formed, for example, by forming a foamed rubber layer of an acrylonitrile butadiene rubber (NBR) or the like on a surface of a metal shaft. The transfer rollers 61 are applied with a transfer voltage by a transfer voltage power source 115 (FIG. 2), and transfer the toner images on the surfaces of the photosensitive drums 11 to the print medium P.

The transfer belt 62 suction-holds the print medium P on a surface thereof by an electrostatic force, and moves in a direction indicated by an arrow F2. The belt drive roller 63 is rotated by a belt motor 65 (FIG. 2), and causes the transfer belt 62 to move. The idle roller 64 applies a tensional force to the transfer belt 62. The transfer belt 62, the belt drive roller 63 and the belt motor 65 form a carrying mechanism that carries the print medium P along the process units 10M, 10Y, 10Bk, 10C.

The fuser device 7 is arranged on a downstream side of the image forming part 100 in the carrying direction of the print medium P. The print medium P to which a toner image has been transferred is carried to the fuser device 7 by the transfer belt 62.

The fuser device 7 has a fuser roller 72, a fuser belt 71 provided around the fuser roller 72, and a pressing roller 73 pressed against the fuser roller 72 via the fuser belt 71. The fuser roller 72 incorporates therein a heating element 74 (FIG. 2) such as a halogen lamp, and is rotated by a fuser motor 76 (FIG. 2). The pressing roller 73 is pressed against the fuser roller 72, and forms a fusing nip between the fuser belt 71 and the pressing roller 73. The fuser belt 71, the fuser roller 72 and the pressing roller 73 apply heat and pressure to the toner image transferred to the print medium P and fuse the toner image onto the print medium P. A configuration without the fuser belt 71 is also possible.

The medium ejection part 8 is arranged on a downstream side of the fuser device 7 in the carrying direction of the print medium P, and includes ejection roller pairs 81, 82 as two roller pairs. The ejection roller pairs 81, 82 carry the print medium P carried out from the fuser device 7 along an ejection carrying path F3 and eject the print medium P to outside of the image forming apparatus 1. A stacker part 84 in which mediums ejected by the ejection roller pairs 81, 82 are stacked is provided at an upper portion of the image forming apparatus 1.

The image forming apparatus 1 further includes a re-carrying mechanism 9 that inverts the print medium P onto which a toner image has been fused in a case of double-sided printing (without inverting the print medium P in a case of superimposed printing) and carries the print medium P to the above-described registration roller pair 54. The double-sided printing is a print mode in which a toner image is formed (transferred and fused) on a surface (back surface) on an opposite side with respect to a surface (front surface) of the print medium P onto which a toner image has been fused. The superimposed printing is a print mode in which, on the same surface of the print medium P on which a toner image has been fused, another toner image is superimposed.

A switching guide 91 that selectively guides the print medium P carried out from the fuser device 7 to the medium ejection part 8 or to the re-carrying mechanism 9 is provided on a downstream side of the fuser device 7 in the carrying direction of the print medium P.

The re-carrying mechanism 9 includes a carrying roller 92 that further carries the print medium P from the switching guide 91, and a switching guide 93 that switches moving direction of the print medium P that has passed through the carrying roller 92. When the switching guide 93 is at a position illustrated using a solid line (during double-sided printing), the print medium P is guided to a temporary retreat path F4, and thereafter, the print medium P carried out in an opposite direction is guided to a return carrying path F5. Further, when the switching guide 93 is at a position illustrated using a broken line (during superimposed printing), the print medium P is guided to the return carrying path F5 without being guided to the temporary retreat path F4.

A carrying roller 94 is arranged in the temporary retreat path F4. The carrying roller 94 inverts front and back sides of the print medium P carried into the temporary retreat path F4 during double-sided printing and carries the print medium P out in an opposite direction. The print medium P carried out in the opposite direction from the carrying roller 94 is guided to the return carrying path F5 by the above-described switching guide 93.

Carrying rollers 95, 96, 97, 98, 99 are arranged along the return carrying path F5. The carrying rollers 95-99 carry the print medium P along the return carrying path F5. The return carrying path F5 joins the carrying path F1 on an upstream side of the above-described registration roller pair 54.

When the image forming apparatus 1 does not have a double-sided printing function, a configuration in which the re-carrying mechanism 9 is not provided is also possible.

In FIG. 1, a direction of a rotation axis of the photosensitive drum 11 is defined as an X direction. The X direction is also a width direction of the print medium P. Axial directions of the rollers of the medium supply part 5, the process units 10, the transfer unit 6, the fuser device 7, the medium ejection part 8 and the re-carrying mechanism 9 described above are parallel to the X direction. The carrying direction of the print medium P when passing through the process units 10 is defined as a Y direction (more specifically, a +Y direction). Here, an XY plane is a horizontal plane. A direction orthogonal to the XY plane, here, a vertical direction, is defined as a Z direction.

<Textile Printing Toners>

In the present embodiment, magenta, yellow, black and cyan textile printing toners (textile printing coloring materials: textile printing developers) having a sublimation transfer property are used in the process units 10M, 10Y, 10Bk, 10C. A textile printing toner includes a textile printing dye or a textile printing pigment (here, a textile printing dye).

The textile printing magenta toner contains a textile printing magenta dye, a binding agent, and a charge control agent. The textile printing magenta dye is, for example, C.I. Reactive Red 3, C.I. Disperse Red 50, C.I. Disperse Red 92, or the like.

The binding agent is, for example, a polyester resin, a styrene-acrylic resin, an epoxy resin, a styrene-butadiene resin, or the like. The charge control agent is, for example, an azo complex, a salicylic acid complex, a calixarene complex, or the like. Further, in addition to the dye, the binding agent and the charge control agent, a release agent may be contained.

The textile printing yellow toner contains a textile printing yellow dye, a binding agent, and a charge control agent. The textile printing yellow dye is, for example, C.I. Reactive Yellow 2, C. I. Disperse Yellow 54, Disperse Yellow 160, C. I. Yellow 114, or the like. The binding agent and the charge control agent are the same as in the textile printing magenta toner.

The textile printing black toner contains a textile printing black dye, a binding agent, and a charge control agent. The textile printing black dye is, for example, C.L Reactive Black 5, or the like. However, the textile printing black dye may be, for example, a mixture of a textile printing yellow dye, a textile printing magenta dye and a textile printing cyan dye. The binding agent and the charge control agent are the same as in the textile printing magenta toner.

The textile printing cyan toner contains a textile printing cyan dye, a binding agent, and a charge control agent. The textile printing cyan dye is, for example, C.L Disperse Blue 60, C.L Reactive Blue 15, C.L Disperse Blue 359, C.L Solvent Blue 63, C.L Disperse Blue 165, Cibacron Turquoise Blue FGF-P, or the like. The binding agent and the charge control agent are the same as in the textile printing magenta toner.

A content of the textile printing dye (the textile printing magenta dye, the textile printing yellow dye, the textile printing black dye or the textile printing cyan dye) is not particularly limited, but is, for example, 2 parts by weight-25 parts by weight, preferably, 2 parts by weight-15 parts by weight, with respect to 100 parts by weight of the binding agent.

More particularly, when specifying a color, the contents of the textile printing dye of magenta, yellow and cyan range from 2 parts by weight to 25 parts by weight, preferably, from 2 parts by weight to 15 parts by weight, with respect to 100 parts by weight of the binding agent. On the other hand, the content of the textile printing dye of black ranges from 2 parts by weight to 50 parts by weight, preferably, from 2 parts by weight to 30 parts by weight, with respect to 100 parts by weight of the binding agent. The content of black dye has a greater range than that of the contents of other colors.

A content of the release agent is not particularly limited, but is, for example, 0.1 parts by weight-20 parts by weight, preferably, 0.5 parts by weight-12 parts by weight, with respect to 100 parts by weight of the binding agent.

A content of the charge control agent is not particularly limited, but is, for example, 0.05 parts by weight-15 parts by weight with respect to 100 parts by weight of the binding agent. A content of an external additive is not particularly limited, but is, for example, 0.01 parts by weight-10 parts by weight, preferably, 0.05 parts by weight-8 parts by weight, with respect to 100 parts by weight of the binding agent.

These contents might be set equal to all toners (all colors). These contents may be set differently to respective toners.

The textile printing toners can be produced using a pulverization method or a polymerization method. Here, the case where the pulverization method is used is described.

First, the textile printing dye (the textile printing magenta dye, the textile printing yellow dye, the textile printing black dye or the textile printing cyan dye), the binding agent, and the charge control agent are mixed using Henschel mixer. The obtained mixture is melt-kneaded using a twin-screw kneader and is cooled.

The obtained kneaded material is coarsely crushed using a cutter mill having a 2 mm diameter screen, and is pulverized using a collision plate type pulverizer (Dispersion Separator manufactured by Nippon Pneumatic Industries, Ltd.), and thereby, a pulverized product is obtained. Further, toner base particles are obtained by classifying the pulverized product using an air classifier.

Finally, an external additive is mixed with the toner base particles, and the mixture is stirred for 3 minutes using a Henschel mixer. As a result, the textile printing toner is obtained. The method for producing the textile printing toner is not limited to a pulverization method or a polymerization method. Other methods may also be used, or multiple methods may be combined. Examples of polymerization methods include an emulsion polymerization aggregation method, a dissolution suspension method, and the like.

The textile printing toner described here is, for example, a negatively charged toner of a one-component development method. That is, the textile printing toner has a negative charge polarity. The one-component development method is a method in which an appropriate charge amount is imparted to the toner itself without using a carrier (magnetic particles) for imparting charge to the toner. In contrast, a two-component development method is a method in which a carrier and a toner are mixed and thereby an appropriate charge amount is imparted to the toner using friction between the carrier and the toner.

In the present embodiment, the textile printing toner is a developer of a one-component development method in which a carrier is not used. However, a developer of a two-component development method in which a textile printing toner and a carrier are used may also be used.

A dye (textile printing dye) used in a textile printing toner is different in characteristics from a dye or a pigment used in an ordinary color toner. Specifically, a textile printing dye contained in a textile printing toner has sublimability that the textile printing dye is vaporized by applying heat and pressure.

A textile printing toner image formed on the print medium P such as a print sheet is superimposed on the textile printing-target medium L which is a fabric such as a T-shirt, and is heated with an iron or the like, and thereby, the textile printing dye sublimates and migrates to the textile printing-target medium L, and the toner image is transferred to the textile printing-target medium L. This is referred to as sublimation transfer.

In the example illustrated in FIG. 1, the magenta, yellow, black and cyan process units 10M, 10Y, 10Bk, 10C are arranged in this order along the carrying direction of the print medium P. This order is a descending order of the sublimabilities of the textile printing dyes respectively contained in the textile printing toners. The sublimability of a textile printing dye is expressed by a weight change start temperature (weight reduction start temperature) or a temperature rising rate (temperature change rate of sublimation transfer efficiency) of a textile printing toner, and this will be described later.

The sublimability of a textile printing dye may be defined from a density (or optical density value: O.D. value 1) on a print medium P on which an image is printed and another density (O.D. value 2) on a textile printing-target medium L after the sublimation transfer. A formula below may be useful to determine the sublimability:

(O.D. value 2)/(O.D. value 1)×100≤a case of 30% or more.

<Control System>

Next, a control system of the image forming apparatus 1 is described. FIG. 2 is a block diagram illustrating the control system of the image forming apparatus 1. The image forming apparatus 1 includes a control device 101 that controls an overall operation of the apparatus, an I/F (interface) controller 102, a reception memory 103, an image data editing memory 104, an operation panel 105, and a sensor group 106.

The control device 101 includes, for example, a microprocessor, a read only memory (ROM), a random access memory (RAM), an input and output port, a timer, and the like. The control device 101 receives, for example, print data and a control command from a host device such as a personal computer via the I/F controller 102, and performs control for a print operation (image formation) of the image forming apparatus 1.

The I/F controller 102 transmits information (printer information) of the image forming apparatus 1 to the host device, analyzes a command received from the host device, and processes data received from the host device.

The reception memory 103 temporarily stores, for each color, print data input from the host device via the I/F controller 102. The image data editing memory 104 edits and stores, as image data, the print data temporarily stored in the reception memory 103.

The operation panel 105 has a display part (for example, an LED display part) for displaying a state of the image forming apparatus 1 and an operation part for an operator to input an instruction for the image forming apparatus 1, and is configured as, for example, a touch panel. It is also possible that the display part and the operation part are separately provided.

The sensor group 106 includes various sensors for monitoring an operating state of the image forming apparatus 1, for example, multiple medium position sensors (movement sensors) that detect a carrying position of the print medium P, a temperature sensor, a humidity sensor, a density sensor for density measurement, and the like. An output of the sensor group 106 is input to the control device 101.

The image forming apparatus 1 further includes a power source controller 110, a head controller 116, a drive controller 117, a belt drive controller 118, a fuser controller 119, and a sheet feeding and carrying controller 120.

Based on an instruction of the control device 101, the power source controller 110 controls the charging voltage power source 111 (Charging Volt. PS in FIG. 2), the development voltage power source 112 (Develop. Volt. PS), the supply voltage power source 113 (Supply Volt. PS), the blade voltage power source 114 (Blade Volt. PS), and the transfer voltage power source 115 (Transfer Volt. PS).

The charging voltage power source 111 applies a charging voltage to the charging roller 12. The development voltage power source 112 applies a development voltage to the development roller 14. The supply voltage power source 113 applies a supply voltage to the supply roller 15. The blade voltage power source 114 applies a blade voltage to the development blade 16. The transfer voltage power source 115 applies a transfer voltage to the transfer roller 61.

Based on an instruction of the control device 101, the head controller 116 causes the print head 13 to emit light to expose the surface of the photosensitive drum 11 based on image data of each color recorded in the image data editing memory 104.

Based on an instruction of control device 101, the drive controller 117 drive-controls the drive motor 19 which is a drive source of the process units 10. A driving force of the drive motor 19 is transmitted to the photosensitive drum 11, the development roller 14, and the supply roller 15. Further, the charging roller 12 rotates following the rotation of the photosensitive drum 11.

Based on an instruction of control device 101, the belt drive controller 118 drives and controls the belt motor 65 that rotates the belt drive roller 63.

Based on an instruction of control device 101 and a detected temperature of a thermistor 75 provided in the fuser device 7, the fuser controller 119 performs on-off control of the heating element 74 incorporated in the fuser roller 72 to keep a surface temperature of the fuser roller 72 at a constant temperature. The fuser controller 119 further drive-controls the fuser motor 76 that rotates the fuser roller 72. The rotation of the fuser motor 76 is also transmitted to the ejection roller pairs 81, 82.

Based on an instruction of the control device 101, the sheet feeding and carrying controller 120 controls a sheet feeding motor 56 that rotates the pickup roller 51, the feed roller 52 and the retard roller 53, a carrying motor 57 that rotates the registration roller pair 54 and the carrying roller pair 55, and clutches for transmitting power of these motors.

<Operation of Image Forming Apparatus>

Next, an operation of the image forming apparatus 1 is described with reference to FIGS. 1 and 2. The control device 101 of the image forming apparatus 1 starts a print operation (image formation) when a print command and print data are received from the host device via the I/F controller 102. The control device 101 temporarily stores the print data in the reception memory 103, edits the stored print data to generate image data, and records the image data in the image data editing memory 104.

The control device 101 further causes the sheet feeding and carrying controller 120 to drive the sheet feeding motor 56. As a result, the pickup roller 51 rotates to feed out the print medium P from the sheet feeding tray 50, and the feed roller 52 and the retard roller 53 rotate to feed the print medium P to the carrying path F1. Further, the carrying motor 57 causes the registration roller pair 54 to start rotating at a predetermined timing to carry the print medium P while correcting a skew of the print medium P, and causes the carrying roller pair 55 to carry the print medium P along the carrying path F1 to the transfer belt 62.

The transfer belt 62 moves due to the rotation of the belt drive roller 63, suction-holds the print medium P and carries the print medium P to the process units 10M, 10Y, 10K, 10C in this order.

The control device 101 forms toner images of the respective colors in the process units 10. That is, the charging voltage power source 111, the development voltage power source 112, the supply voltage power source 113 and the blade voltage power source 114 respectively apply a charging voltage, a development voltage, a supply voltage and a blade voltage to the charging roller 12, the development roller 14, the supply roller 15 and the development blade 16.

The control device 101 further causes the drive controller 117 to drive the drive motor 19 to rotate the photosensitive drum 11. Along with the rotation of the photosensitive drum 11, the charging roller 12, the development roller 14 and the supply roller 15 also rotate. The charging roller 12 uniformly charges the surface of the photosensitive drum 11.

Based on the image data recorded in the image data editing memory 104, the control device 101 further causes the head controller 116 to perform light emission control. The head controller 116 causes the print head 13 to emit light to the surface of the photosensitive drum 11 to form an electrostatic latent image.

The electrostatic latent image formed on the surface of the photosensitive drum 11 is developed by the toner attached to the development roller 14, and a toner image is formed on the surface of the photosensitive drum 11. When the toner image approaches a surface of the transfer belt 62 due to the rotation of the photosensitive drum 11, the transfer voltage power source 115 applies a transfer voltage to the transfer roller 61. As a result, the toner image formed on the surface of the photosensitive drum 11 is transferred to the print medium P on the transfer belt 62.

In this way, the toner images of the respective colors formed by the process units 10M, 10Y, 10K, 10C are sequentially transferred to the print medium P and are superimposed on each other. The print medium P to which the toner images of the respective colors have been transferred is further carried by the transfer belt 62 and reaches the fuser device 7. In the fuser device 7, the print medium P is pressed and heated in the fusing nip between the fuser belt 71 and pressing roller 73, and the toner image is fused onto the print medium P.

The print medium P onto which the toner image has been fused is ejected to the outside of the image forming apparatus 1 by the ejection roller pairs 81, 82, and is stacked on the stacker part 84. As a result, the formation of the color image on the print medium P is completed.

<Operation>

Next, an operation of the image forming apparatus 1 of the first embodiment is described. A mixed color image may be formed by superimposing textile printing toners of multiple colors among the magenta, yellow, black and cyan colors. For example, a blue image can be obtained by superimposing a magenta image formed using a textile printing magenta toner and a cyan image formed using a textile printing cyan toner.

Figure 3:
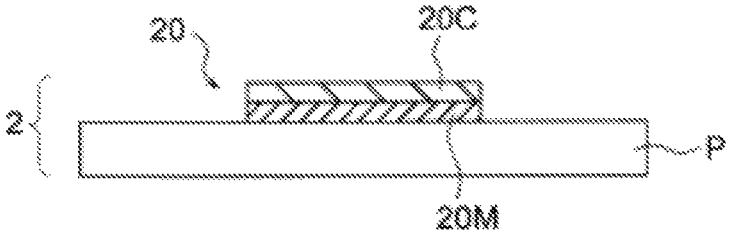
FIG. 3 is schematic diagram illustrating a print image on a print medium in the first embodiment.

FIG. 3 illustrates a blue image (print image) 20 formed on the print medium P by the image forming apparatus 1. In the image forming apparatus 1, the cyan process unit 10C is arranged on a downstream side of the magenta process unit 10M in the carrying direction of the print medium P. Therefore, a magenta image 20M is first transferred to print medium P, and a cyan image 20C is transferred on the magenta image 20M. In this state, the magenta image 20M and the cyan image 20C are fused onto the print medium P and become the print image 20. The print medium P on which the print image 20 has been formed is referred to as a coloring medium (or textile printing medium) 2.

Figure 4:
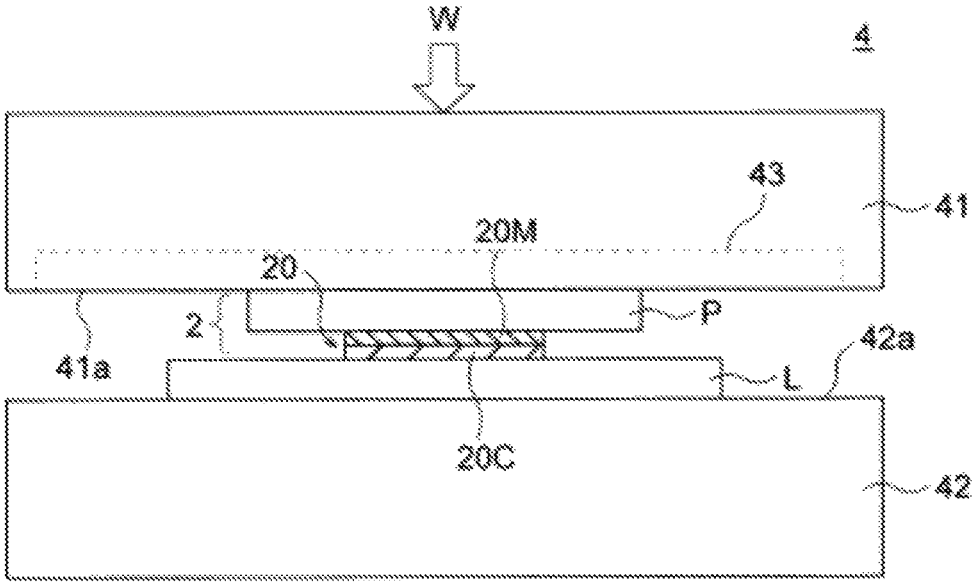
FIG. 4 is schematic diagram illustrating a textile printing process in the first embodiment.

FIG. 4 illustrates a textile printing process of from the print medium P to the textile printing-target medium L. The textile printing-target medium L is, for example, a fabric such as a T-shirt, and is here formed of a polyester fiber. A hot press machine 4 is used for textile printing transfer. The hot press machine 4 is also referred to as an iron press (or iron press machine) or a heat press machine (or heat press machine).

The hot press machine 4 includes an iron upper part 41 positioned on an upper side and an iron lower part 42 positioned on a lower side. The iron upper part 41 has a flat heating surface 41*a* facing the iron lower part 42. A heat source 43 for heating the heating surface 41*a* is incorporated inside the iron upper part 41. In the hot press machine 4, a heat generation amount of the heat source 43 is controlled such that a surface temperature of the heating surface 41*a* is maintained at a desired temperature.

The iron lower part 42 has a placing surface 42*a* facing the iron upper part 41. The placing surface 42*a* is a flat surface on which the textile printing-target medium L such as cloth is placed.

Further, the hot press machine 4 has a displacement mechanism that vertically displaces the iron upper part 41 with the heating surface 41*a* facing the placing surface 42*a*. As a result, the iron upper part 41 can be pressed against the iron lower part 42 or separated away from the iron lower part 42. The hot press machine 4 is configured such that a pressure (applied pressure) when the iron upper part 41 is pressed against the iron lower part 42 can be set.

Here, as the hot press machine 4, a "TP-608M" manufactured by Taiyo Seiki Co., Ltd., is used. Further, the surface temperature (that is, a heating temperature) and a heating time period of the heating surface 41*a* of the hot press machine 4 in the textile printing process are appropriately changed.

In the print medium P, as described above, the cyan image 20C is formed on the magenta image 20M. Therefore, when the print medium P on which the print image 20 is formed (that is, the coloring medium 2) and the textile printing-target medium L are superimposed, as illustrated in FIG. 3, the cyan image 20C is positioned on the textile printing-target medium L side, and the magenta image 20M is positioned on the cyan image 20C.

Figure 5:
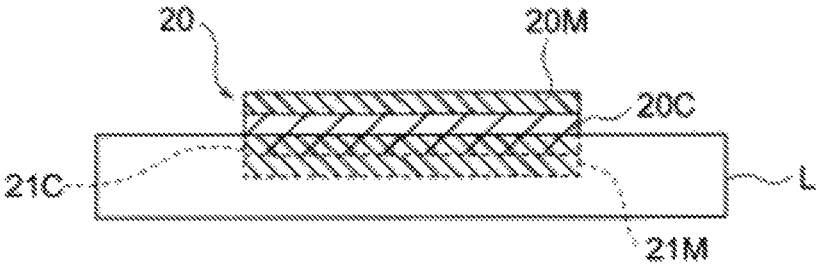
FIG. 5 is schematic diagram illustrating a sublimation transfer state of textile printing dyes.

FIG. 5 schematically illustrates a sublimation transfer state of the dyes respectively contained in the magenta image 20M and the cyan image 20C. Comparing the textile printing magenta dye of the textile printing magenta toner with the textile printing cyan dye of the textile printing cyan toner, the sublimability of the textile printing magenta dye is high, and the sublimability of the textile printing cyan dye is low. Due to this difference in sublimability, the textile printing magenta dye (indicated using a reference numeral symbol "21M" in FIG. 5) quickly migrates to the textile printing-target medium L, but the textile printing cyan dye (indicated using a reference numeral symbol "21C" in FIG. 5) migrates to the textile printing-target medium L with a delay.

Therefore, by forming the cyan image 20C on the textile printing-target medium L side, the migration of the textile printing magenta dye to the inside of the textile printing-target medium L can be delayed by the textile printing cyan dye. As a result, the textile printing magenta dye and the textile printing cyan dye substantially equally remain on the surface of the textile printing-target medium L. That is, decreases in magenta and cyan densities on the surface of the textile printing-target medium L are suppressed. As a result, a color scheme of the image on the print medium P and a color scheme of the image on the textile printing-target medium L can be the same, and color reproducibility can be improved.

Figure 6:
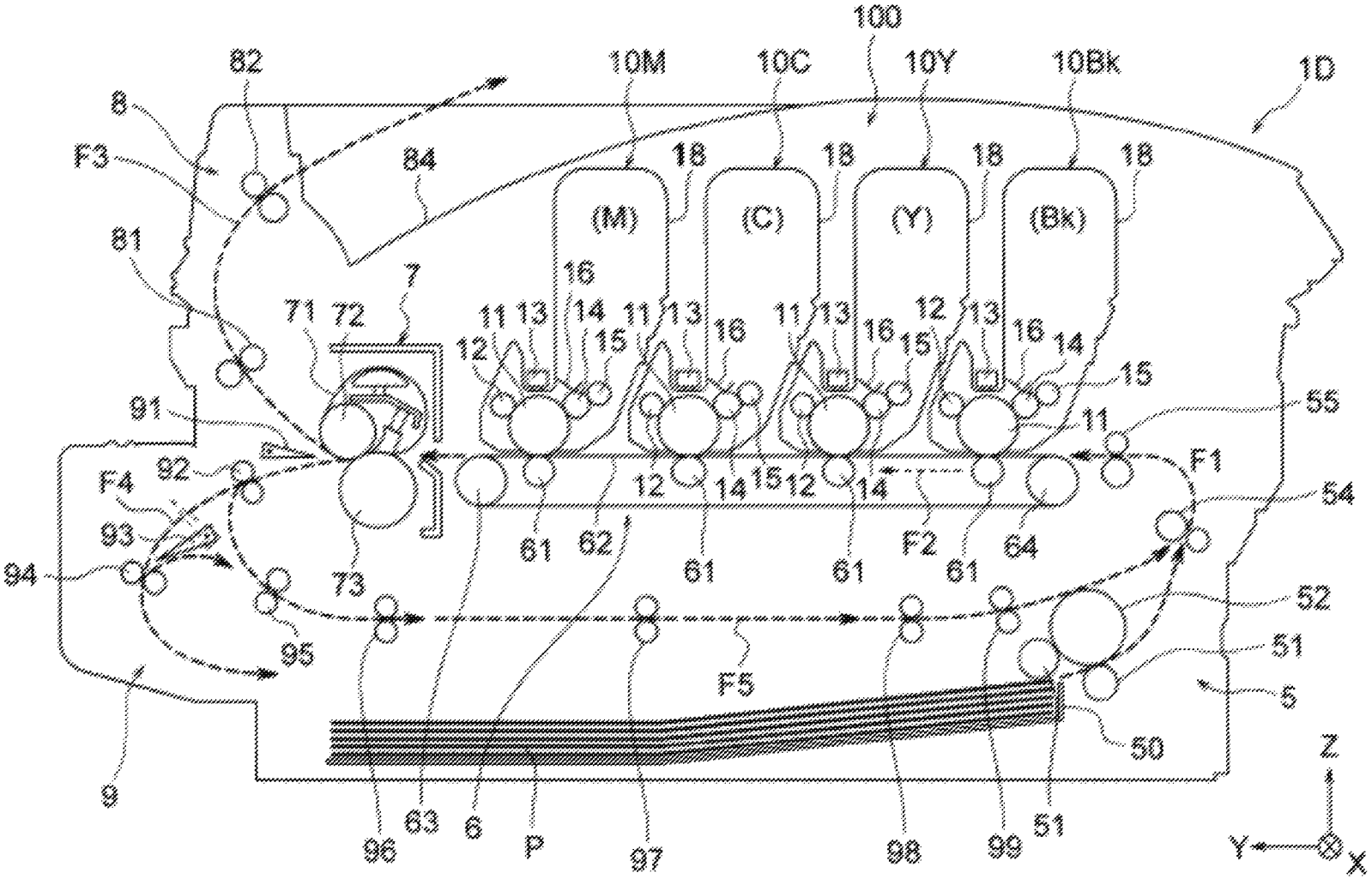
FIG. 6 illustrates an image forming apparatus of a comparative example.

This point is further described below in comparison with a comparative example. FIG. 6 illustrates a basic configuration of an image forming apparatus 1D of the comparative example. In the image forming apparatus 1D of the comparative example, the black, yellow, cyan, magenta process units 10Bk, 10Y, 10C, 10M are arranged in this order in the carrying direction of the print medium P. In other respects, the image forming apparatus 1D of the comparative example has the same configuration as the image forming apparatus 1 of the first embodiment (FIG. 1).

Figure 7:
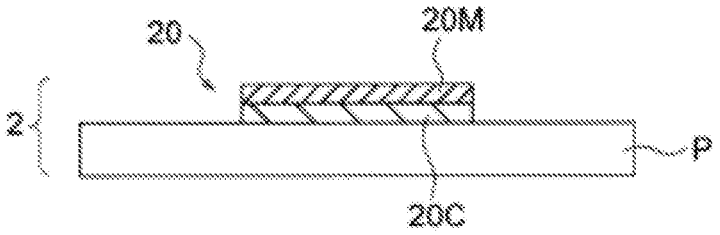
FIG. 7 is schematic diagram illustrating a print image on a print medium in the comparative example.

FIG. 7 illustrates a blue print image 20 formed on the print medium P by the image forming apparatus 100 of the comparative example. As described above, in the image forming apparatus 100, the process unit 10M of the magenta is arranged on a downstream side of the cyan process unit 10C in the carrying direction of the print medium P. Therefore, the cyan image 20C is first transferred to the print medium P, and the magenta image 20M is transferred on the cyan image 20C. In this state, the cyan image 20C and the magenta image 20M are fused onto the print medium P and become the print image 20.

Figure 8:
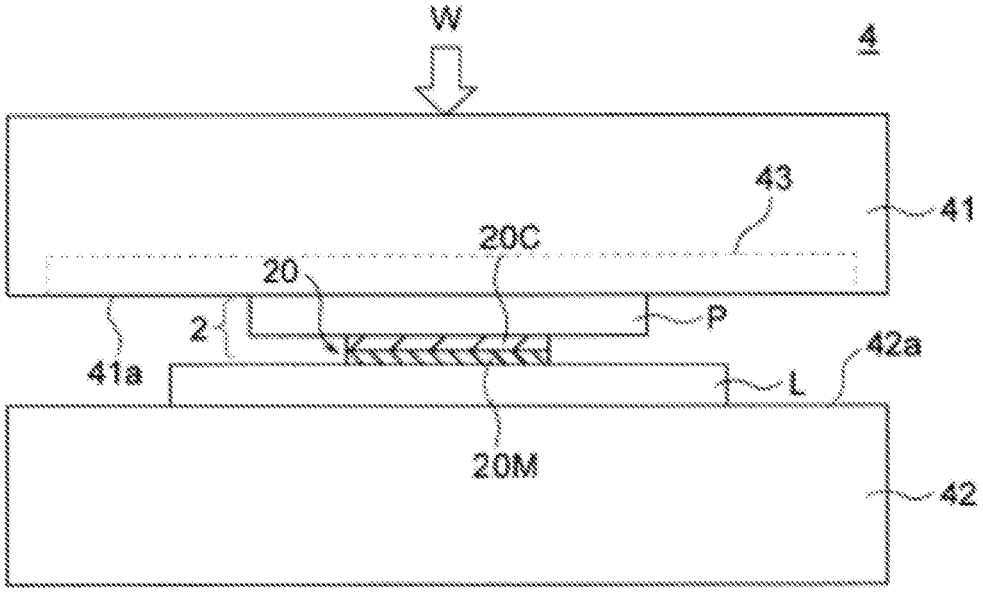
FIG. 8 is a schematic diagram illustrating a textile printing process in the comparative example.

FIG. 8 illustrates a textile printing process of from the print medium P to the textile printing-target medium L in the comparative example. In the print medium P, as described above, the magenta image 20M is formed on the cyan image 20C. Therefore, when the print medium P on which the print image 20 is formed (that is, the coloring medium 2) and the textile printing-target medium L are superimposed, as illustrated in FIG. 8, the magenta image 20M is positioned on the textile printing-target medium L side, and the cyan image 20C is positioned on the magenta image 20M.

Figure 9:
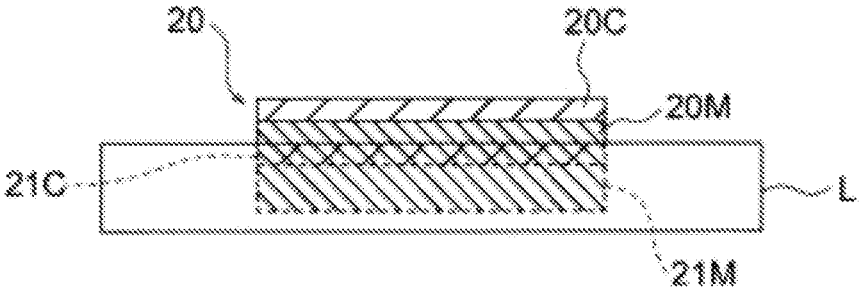
FIG. 9 is schematic diagram illustrating a sublimation transfer state of textile printing dyes in the comparative example.

FIG. 9 schematically illustrates a sublimation transfer state of the textile printing dyes respectively contained in the magenta image 20M and the cyan image 20C in the comparative example. Since the magenta image 20M is positioned on the side close the textile printing-target medium L, the textile printing magenta dye (indicated using a reference numeral symbol "21M") having a high sublimability quickly migrates to the inside of the textile printing-target medium L, whereas the textile printing cyan dye (indicated using a reference numeral symbol "21C") having a low sublimability migrates to the textile printing-target medium L with a delay. As a result, on the surface of the textile printing-target medium L, a difference between the magenta density and the cyan density is increased, and a difference between the color scheme of the image on the print medium P and the color scheme of the image on the textile printing-target medium L is increased. That is, the color reproducibility is decreased.

Figure 10A:
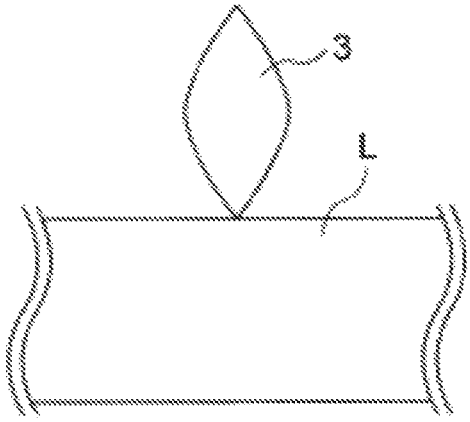
FIGS. 10A-10C are schematic diagrams illustrating states of a textile printing dye migrating to a textile printing-target medium.
Figure 10B:
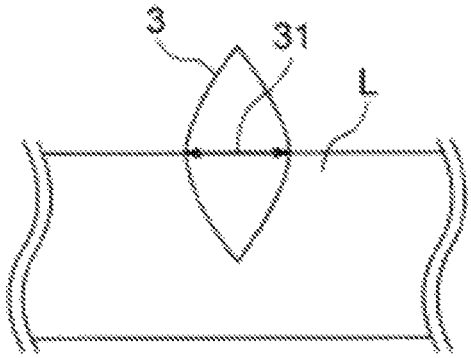
Figure 10C:
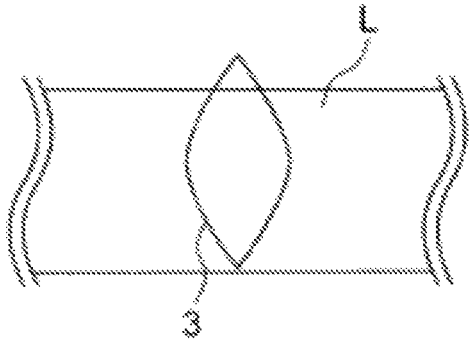

FIGS. 10A-10C are schematic diagrams illustrating states of migration of a textile printing dye to the textile printing-target medium L. A sublimated textile printing dye is indicated using a reference numeral symbol "3." Sublimation of the textile printing dye 3 starts when the textile printing dye 3 is heated, and, as illustrated in FIG. 10A, migration of the textile printing dye 3 starts from the surface of the textile printing-target medium L.

As illustrated in FIG. 10B, as time elapses, the textile printing dye 3 migrates to the inside of the textile printing-target medium L, and an amount of the textile printing dye on the surface of the textile printing-target medium L increases.

As time further elapses, as illustrated in FIG. 10C, the textile printing dye 3 further migrates to the inside (or back side) of the textile printing-target medium L, and the amount of the textile printing dye on the surface of the textile printing-target medium L decreases.

FIGS. 11A-11D are schematic diagrams illustrating states of migration of the textile printing magenta dye 21M and the textile printing cyan dye 21C to the textile printing-target medium L.in the comparative example. In FIGS. 11A-11D, the textile printing magenta dye 21M having a high sublimability are illustrated as small particles, and the textile printing cyan dye 21C having a low sublimability is illustrated as large particles.

Figure 11A:
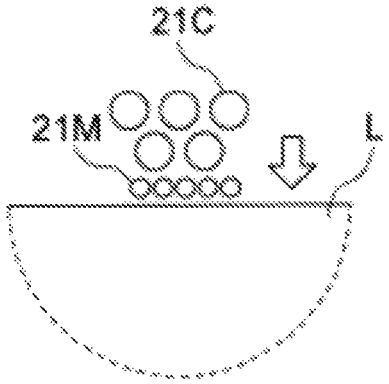
FIGS. 11A-11D are schematic diagrams illustrating states of a textile printing magenta dye and a textile printing cyan dye migrating to a textile printing-target medium in the comparative example.

In the comparative example, as illustrated in FIG. 11A, the textile printing magenta dye 21M having a high sublimability is positioned near the textile printing-target medium L, and the textile printing cyan dye 21C having a low sublimability is positioned far from the textile printing-target medium L.

Figure 11B:
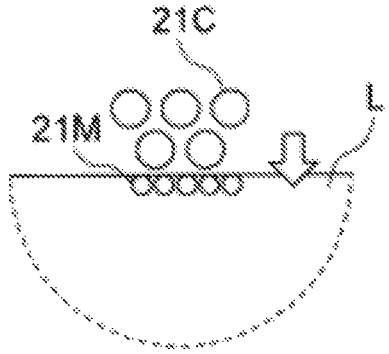
Figure 11C:
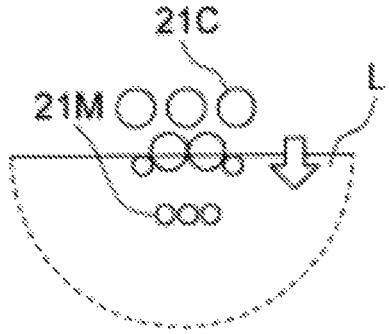

Therefore, as illustrated in FIGS. 11B and 11C, the textile printing magenta dye 21M quickly migrates to the inside of the textile printing-target medium L, whereas the textile printing cyan dye 21C slowly migrates into the textile printing-target medium L.

Figure 11D:
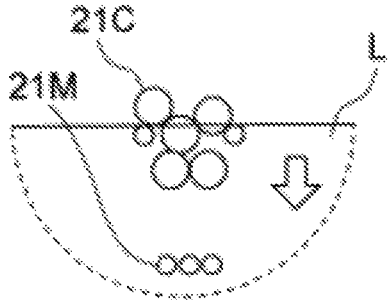

As a result, as illustrated in FIG. 11D, at the point when the cyan density on the surface of the textile printing-target medium L has increased to some extent, the textile printing magenta dye 21M has entered into the inside of the textile printing-target medium L. That is, as described with reference to FIG. 10C, the magenta density on the surface of the textile printing-target medium L has decreased.

Figure 12A:
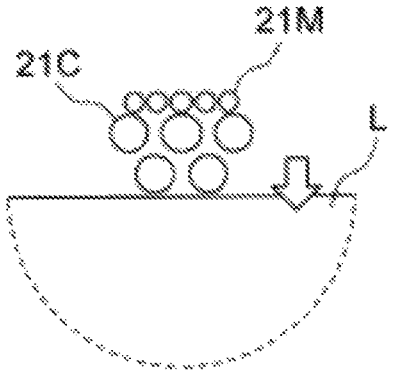
FIGS. 12A-12D are schematic diagrams illustrating states of a textile printing magenta dye and a textile printing cyan dye migrating to a textile printing-target medium in the first embodiment.

FIGS. 12A-12D are schematic diagrams illustrating states of migration of the textile printing magenta dye 21M and the textile printing cyan dye 21C to the textile printing-target medium L.in the first embodiment. In the first embodiment, as illustrated in FIG. 12A, the textile printing cyan dye 21C having a low sublimability is positioned near the textile printing-target medium L, and the textile printing magenta dye 21M having a high sublimability is positioned far from the textile printing-target medium L.

Figure 12B:
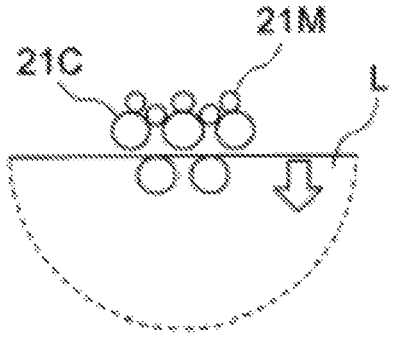
Figure 12C:
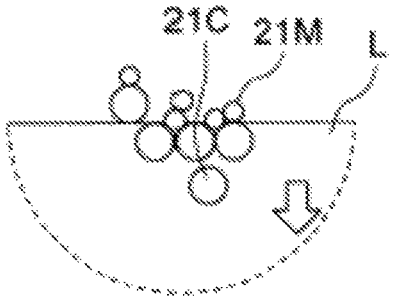

Therefore, as illustrated in FIGS. 12B and 12C, the textile printing cyan dye 21C delays the migration of the textile printing magenta dye 21M to the inside of the textile printing-target medium L.

Figure 12D:
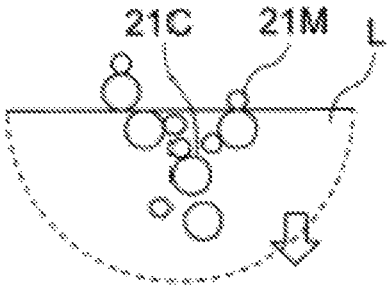

As a result, as illustrated in FIG. 12D, even at the point when the cyan density on the surface of the textile printing-target medium L has increased to some extent, a significant amount of the textile printing magenta dye remains on the surface of the textile printing-target medium L, and thus, a decrease in the magenta density is suppressed. The textile printing magenta dye 21M corresponds to a first textile printing dye (first coloring agent), and the textile printing cyan dye 21C corresponds to a second textile printing dye (second coloring agent).

In this way, in the first embodiment, by positioning the cyan image 20C formed using the textile printing cyan toner (textile printing cyan dye 21C) having a low sublimability on the textile printing-target medium L side of the magenta image 20M formed using the textile printing magenta toner (textile printing magenta dye 21M) having a high sublimability, decreases in the densities of the respective colors on the surface of the textile printing-target medium L can be suppressed, and the color reproducibility can be improved.

Here, the combination of the textile printing magenta dye and the textile printing cyan dye has been described. However, a combination of other colors is also possible as long as an image formed using a textile printing dye having a low sublimability can be formed above an image formed using a textile printing dye having a high sublimability on the high print medium P.

In particular, in the image forming apparatus 1 of the first embodiment (FIG. 1), the magenta, yellow, black, cyan process units 10M, 10Y, 10Bk, 10C are arranged in a descending order of the sublimabilities of the textile printing dyes in the carrying direction of the print medium P. The magenta M has the highest sublimability, the cyan C has the lowest sublimability among these toners.

Therefore, for example, when a red (R) image is formed using the textile printing magenta toner and the textile printing yellow toner, a textile printing yellow toner image is formed on a textile printing magenta toner image on the print medium P. As a result, on the textile printing-target medium L, the textile printing yellow toner having a low sublimability is positioned on the side close the textile printing-target medium L, and the textile printing magenta toner having a high sublimability is positioned on a side far from the textile printing-target medium L. Therefore, similarly to the case of cyan and magenta described above, decreases in the densities of the respective colors can be suppressed, and the color reproducibility can be improved.

The same applies to a case where a green (G) image is formed using the textile printing yellow toner and the textile printing cyan toner.

<Sublimability of Textile Printing Toner>

Next, a thermal property as an indicator of the sublimability of a textile printing toner is described. Here, a weight reduction start temperature of a textile printing dye measured using a simultaneous thermal differential thermo-thermogravimetric analyzer (TG-DTA) is described.

As the simultaneous thermal differential thermo-thermogravimetric analyzer, a "TG-DTA 6200 EXSTAR 6000" manufactured by Seiko Instruments Inc was used. The textile printing magenta toner, the textile printing yellow toner, the textile printing black toner and the textile printing cyan toner were all placed in a nitrogen atmosphere, and were heated in a temperature range of 25° C.-600° C. at a temperature rising rate of 20° C./minute.

Figure 13A:
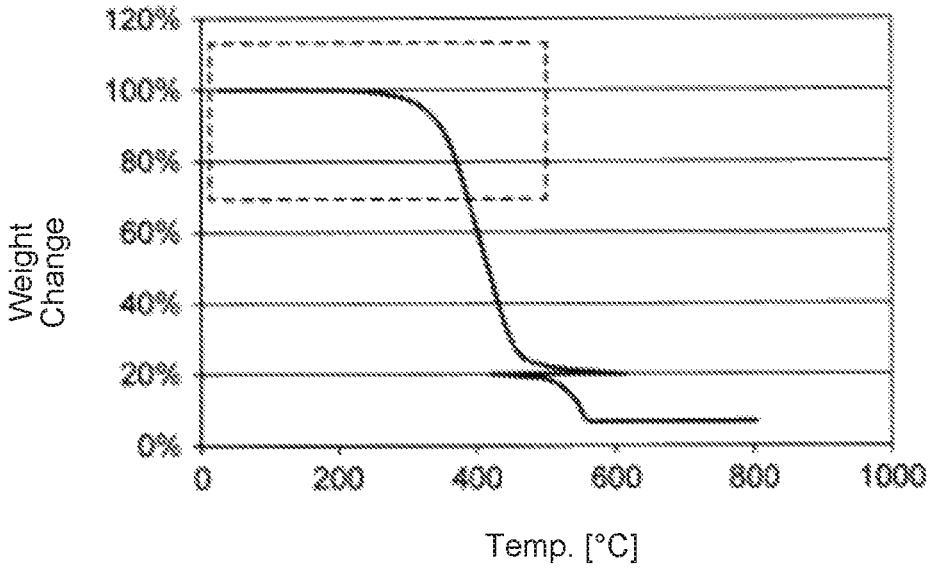
FIGS. 13A and 13B are graphs showing temperature-dependence of the weight of a textile printing magenta toner.
Figure 13B:
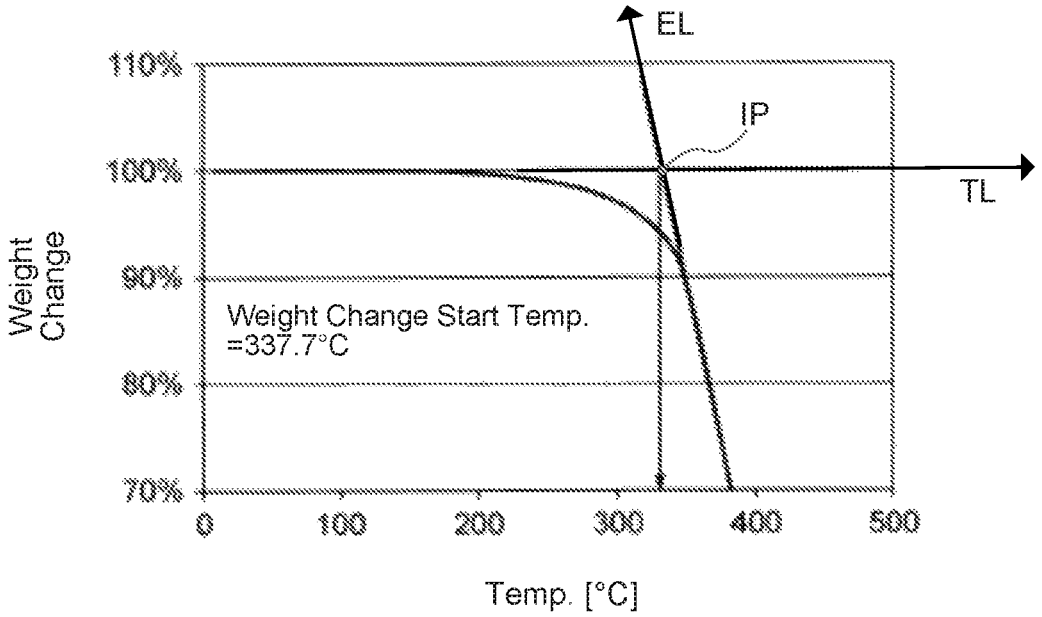

FIG. 13A is a graph showing a weight change of a textile printing magenta toner. The vertical axis shows the weight change (that is, a relative weight with respect to a weight at a normal temperature), and the horizontal axis shows the temperature. FIG. 13B is an enlarged graph showing a portion where a weight change occurred in FIG. 13A (indicated using a broken line in the figure).

Figure 14A:
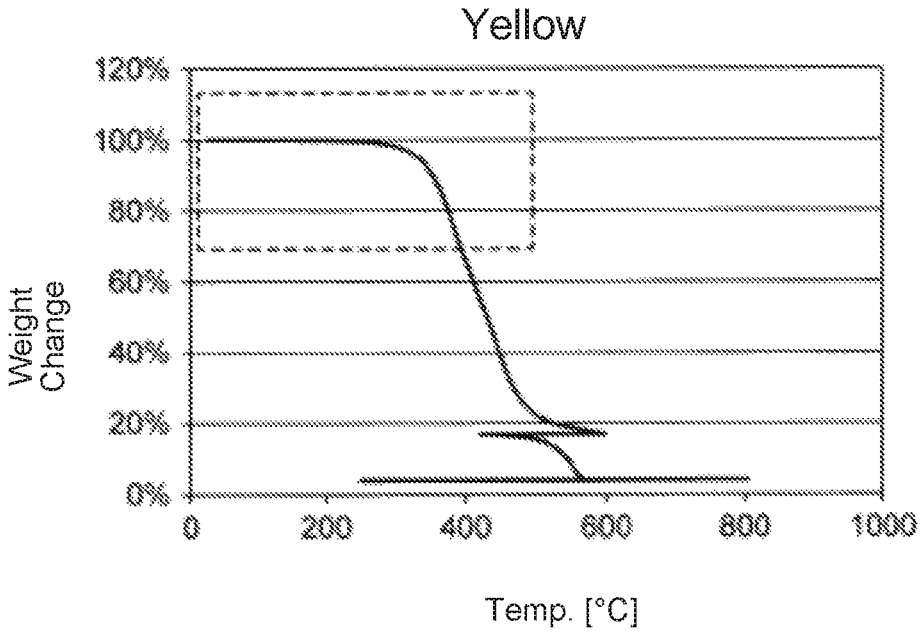
FIGS. 14A and 14B are graphs showing temperature-dependence of the weight of a textile printing yellow toner.
Figure 14B:
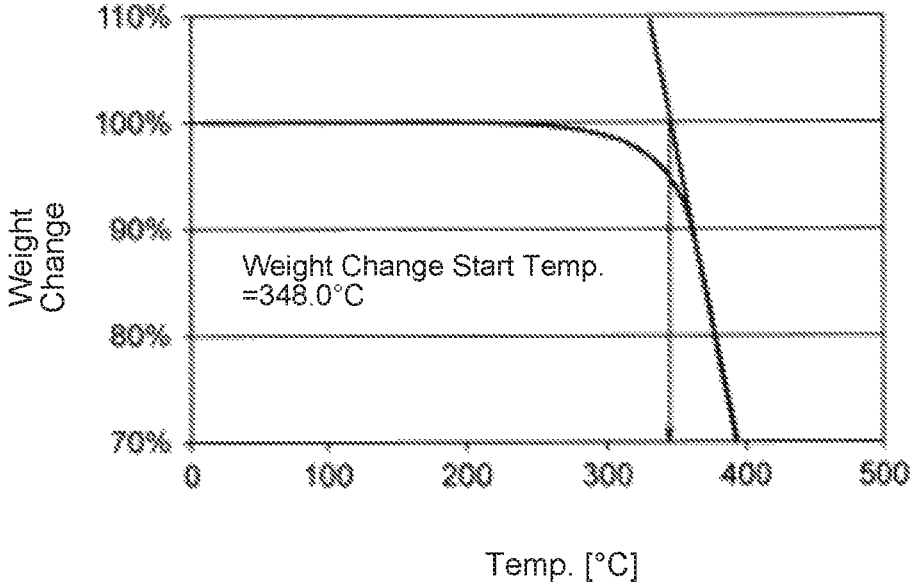
Figure 15A:
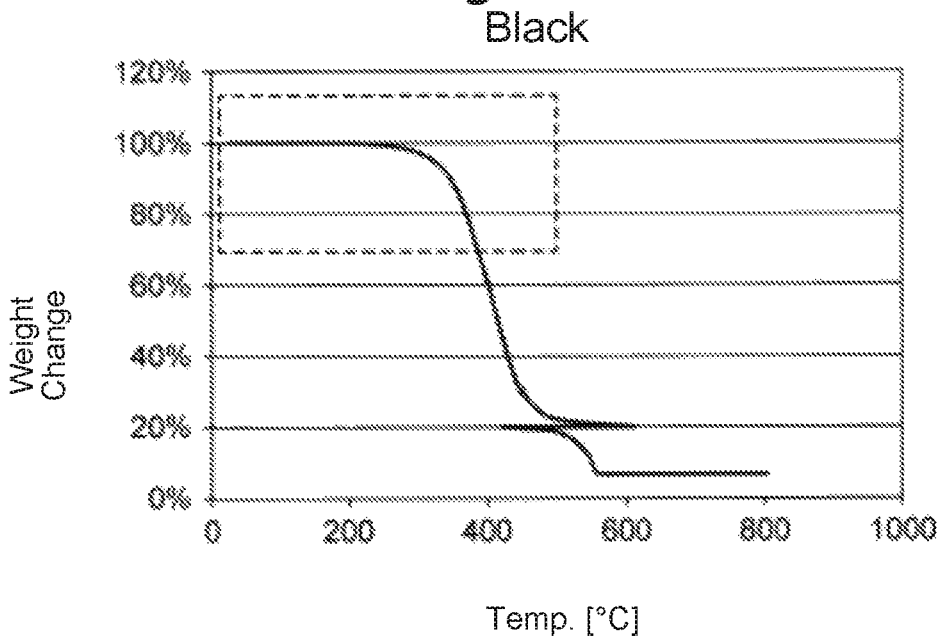
FIGS. 15A and 15B are graphs showing temperature-dependence of the weight of a textile printing black toner.
Figure 15B:
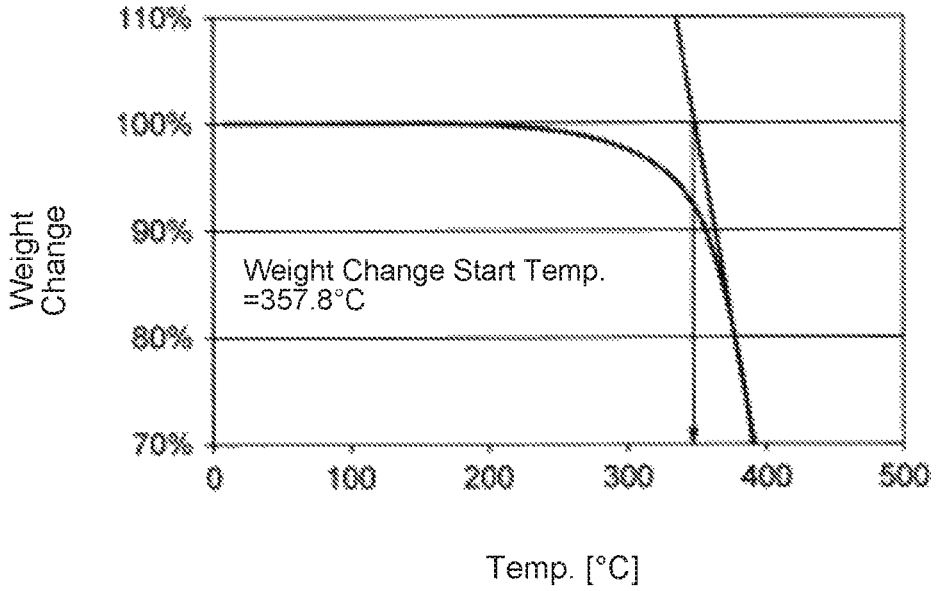
Figure 16A:
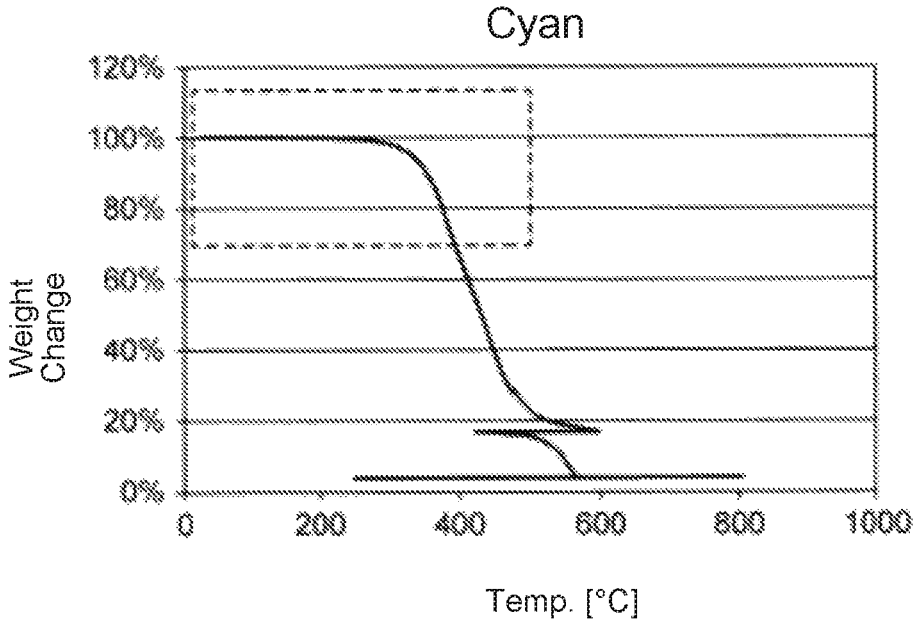
FIGS. 16A and 16B are graphs showing temperature-dependence of the weight of a textile printing cyan toner.
Figure 16B:
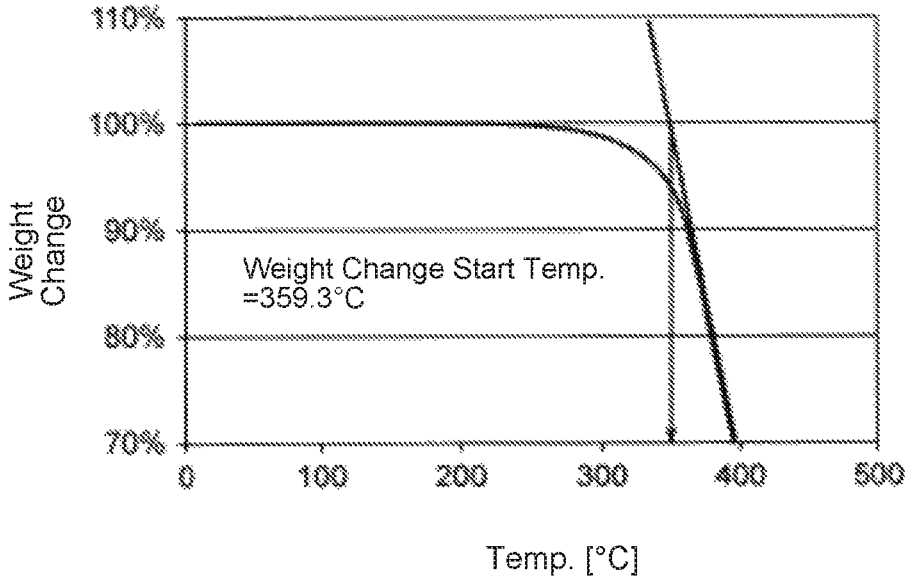

Similarly, FIGS. 14A and 14B are graphs showing a weight change of the textile printing yellow toner. FIGS. 15A and 15B are graphs showing a weight change of the textile printing black toner. FIGS. 16A and 16B are graphs showing a weight change of the textile printing cyan toner.

In FIG. 13B, a temperature at an intersection (IP) between an extension line (EL) extending a baseline before the start of the weight change and a tangent line (TL) of a maximum slope with respect to a curve after the start of the weight change was defined as the weight reduction start temperature (weight change start temperature) of the textile printing magenta toner. The weight reduction start temperature of the textile printing magenta toner was 337.7° C.

Similarly, from FIG. 14B, the weight reduction start temperature of the textile printing yellow toner was 348.0° C. From FIG. 15B, the weight reduction start temperature of the textile printing black toner was 357.8° C. From FIG. 16B, the weight reduction start temperature of the textile printing cyan toner was 359.3° C.

That is, an ascending order of the weight reduction start temperatures is an order of magenta, yellow, black and cyan. A textile printing toner having a lower weight reduction start temperature is easier to sublimate, and thus can more easily dye the textile printing-target medium L. On the other hand, a textile printing toner having a higher weight reduction start temperature is more difficult to sublimate, and thus it is more difficult to dye the textile printing-target medium L using the textile printing toner.

Next, printing experiments using the textile printing toners and results thereof are described. The printing experiments were performed using the image forming apparatus 1 illustrated in FIG. 1. Specifically, a color printer "C841" manufactured by Oki Data Corporation was used.

Figure 17:
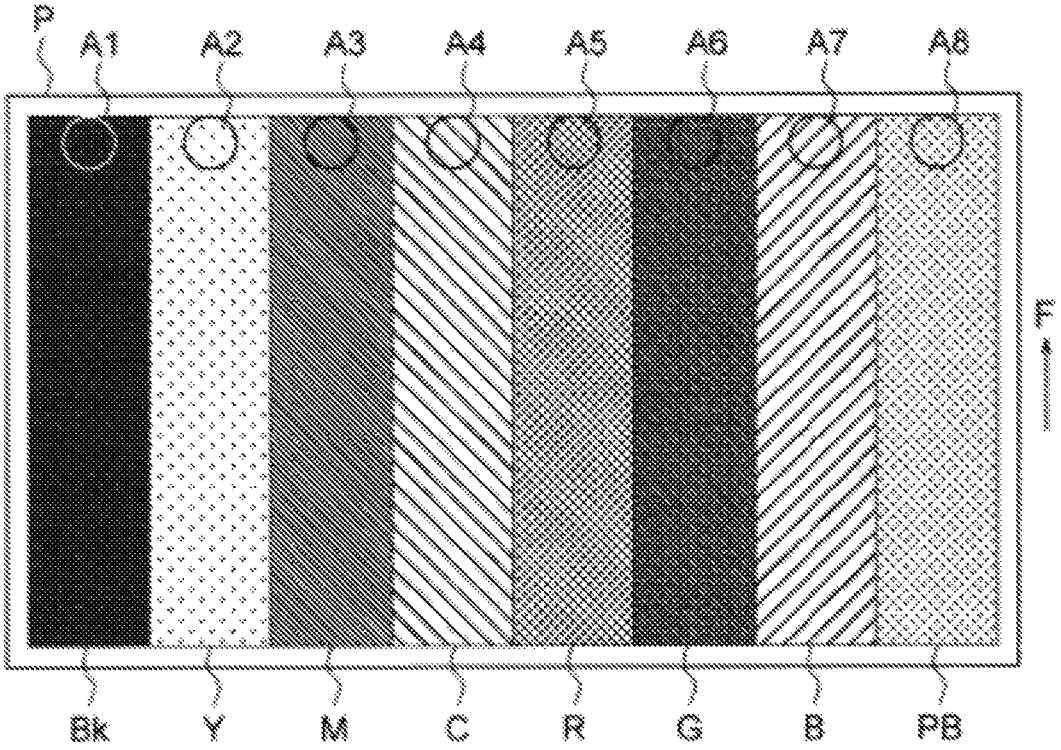
FIG. 17 illustrates a print pattern used in printing experiments.

FIG. 17 illustrates a print pattern used in the printing experiments. In the print pattern, 8 patterns of black (Bk), yellow (Y), magenta (M), cyan (C), red (R), green (G), blue (B) and process black (PB) are formed in a direction orthogonal to the carrying direction of the print medium P (indicated by an arrow F).

The black (Bk) pattern portion was formed by the process unit 10Bk of the image forming apparatus 1; the yellow (Y) pattern portion was formed by the •unit 10Y; the magenta (M) pattern portion was formed by the process unit 10M; and the cyan (C) pattern portion was formed by the process unit 10C.

Further, the red (R) pattern portion was formed by the process units 10M, 10Y; the green (G) pattern portion was formed by the process units 10Y, 10C; the blue (B) pattern portion was formed by the process units 10M, 10C; and the process black (PB) pattern portion was formed by the process units 10M, 10Y, 10C.

Print image densities of the pattern portions of the respective colors are as follows. The print image density is defined by the following formula:

$$\text{Print image density}=[Cm(i)/(Cd\times C0)]\times 100 \quad \text{eq. (1)}$$

at eq. (1), Cm (i) is the number of dots emitted by the print head 13 during Cd rotations of the photosensitive drum 11. C0 is the number of dots that can be emitted by the print head 13 during one rotation of the photosensitive drum 11. Cd×C0 is the number of dots that can be emitted by the print head 13 during Cd rotations of the photosensitive drum 11.

The print image densities of the black (Bk), yellow (Y), magenta (M) and cyan (C) pattern portions were each set to 100%. The print image densities of the red (R), green (G) and blue (B) pattern portions were each set to 200% (for example, in the case of the red (R) pattern portion, the magenta and yellow print image densities were each 100%). The print image density of the process black (PB) pattern portion is set to 240% (the magenta, yellow and cyan print image densities are each 80%).

As the print medium P, "Excellent White A4" (a 70 kg paper sheet, weighing 80 g/m2) manufactured by Oki Data Corporation was used.

Further, when an L * value, an a* value, and a b * value in an L * a* b * color system of the print medium P measured under conditions to be described later are respectively expressed as L * (W), a* (W), and b * (W), the values were $$96.3\leq L^*(W)\leq 96{,}8, \text{ and, } *$$

$$1.7\leq a^*(W)\leq 2.0, \text{ and,}$$

$$-5.6\leq b^*(W)\leq -5.2.$$

A carrying speed of the print medium P in the image forming apparatus 1 was set to 200 mm/second. Further, a fusing temperature in the fuser device 7 was 155±5° C. in a Y direction central portion of the fuser belt 71 and was 135±5° C. in a Y direction central portion of the pressing roller 73.

The print images of the first embodiment (FIG. 3) and the comparative example (FIG. 7) formed in this way were each textile-printed on a textile printing-target medium L using the hot press machine 4 illustrated in FIG. 4. As the textile printing-target medium L, a polyester fabric T-shirt (unbranded product) was used. The surface temperature of the heating surface 41*a* of the hot press machine 4, that is, the heating temperature, was set to 200° C., and the heating time was changed in eight ways from 30 seconds to 240 seconds.

The pressure (that is the applied pressure) between the heating surface 41*a* and the placing surface 42*a* of the hot press machine 4 was set to 61.9 g/cm2. This applied pressure is a value measured 30 seconds after start of pressure application after inserting a sensor sheet of a pressure distribution measurement system "PINCH" manufactured by Nitta Corporation between the heating surface 41*a* and the placing surface 42*a* of the hot press machine 4. The insertion position of the sensor sheet is at the central portions of the heating surface 41*a* and the placing surface 42*a* of the hot press machine 4.

A density of a blue portion of an image textile-printed on the textile printing-target medium L was measured. A density measurement position corresponds a position indicated by a reference numeral symbol "A7" in FIG. 17.

A spectrodensitometer "X-Rite 528" manufactured by X-Rite Incorporated was used for the density measurement. A measurement mode of the spectrodensitometer "X-Rite 528" was set to "Density Measurement Mode," and a status was set to "Status I." Further, a white reference was set to "Absolute White Reference," and "No Polarizing Filter" was selected, and calibration was performed using a white calibration plate before the density measurement.

"Status I" is a setting of a wavelength region to be evaluated, and is defined in "ISO 5-3 Photography and graphic technology—Density measurements—Part 3: Spectral conditions."

During the density measurement, a black paper sheet (black paper medium) was placed under the textile printing-target medium L. When an L * value, an a* value, and a b * value in an L * a* b * color system of a black paper sheet are respectively expressed as L * (Bk), a* (Bk), and b * (Bk), a black paper sheet satisfying $$25.1 \leq L^*(Bk) \leq 25.9,$$

$$0.2 \leq a^*(Bk) \leq 0.3, \text{ and}$$

$$0.5 \leq b^*(Bk) \leq 0.7$$

was used. Specifically, a black paper sheet "color high-quality paper black," manufactured by Hokuetsu Kishu Paper Co., Ltd., was used.

Image densities obtained using the spectrodensitometer "X-Rite 528" are obtained as four numerical values including a V value (Visual Value), an M value (Magenta Value), a Y value (Yellow Value) and a C value (Cyan Value).

The V value, the Y value, the M value and the C value of the image obtained this way are defined as optical densities (or optical density values, rOD) as the image densities.

Figure 18:
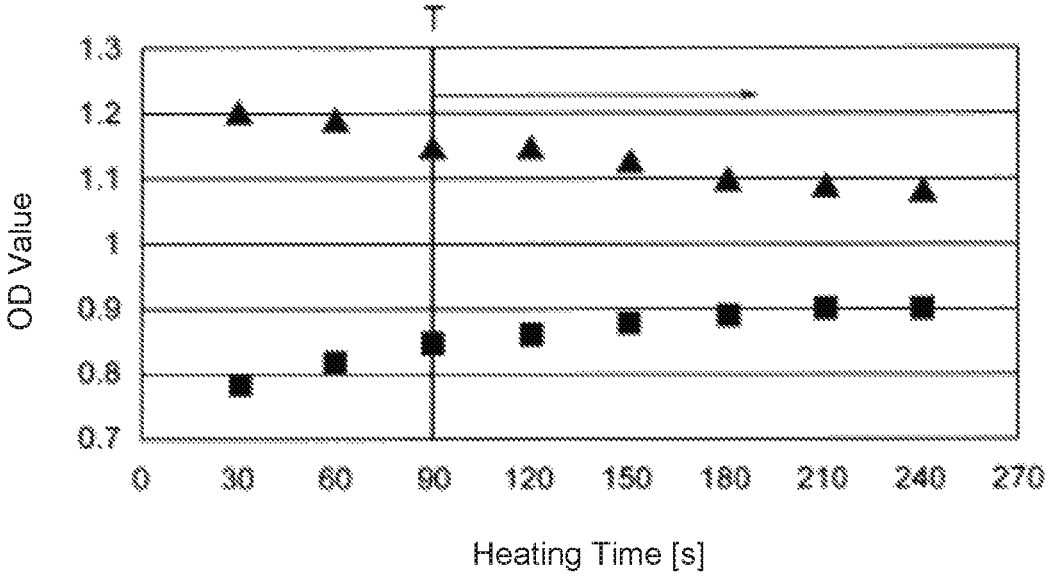
FIG. 18 is a graph showing relationships between optical densities and heating time in the comparative example.
Figures 19, 20:
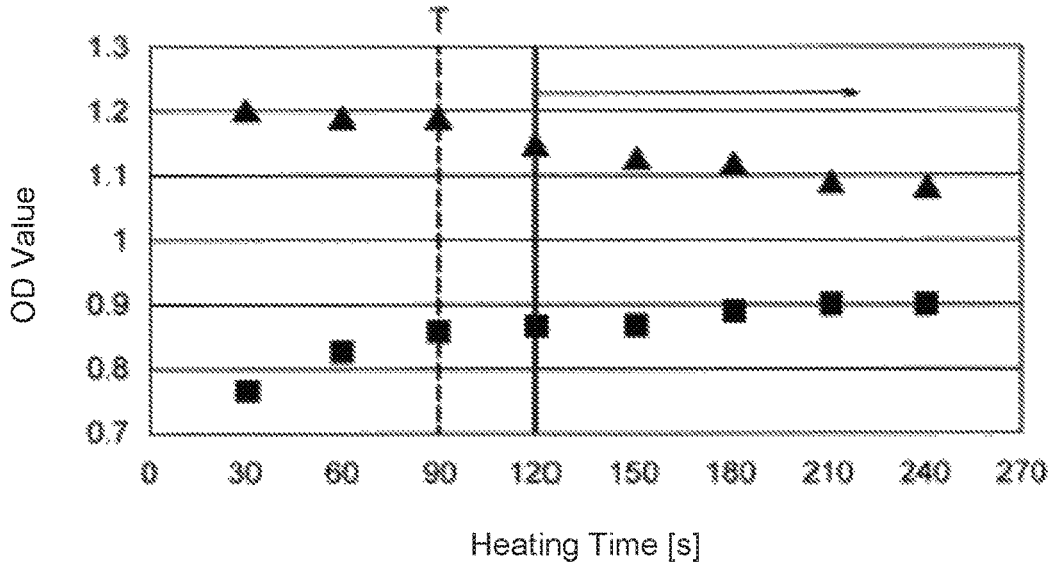
FIG. 19 is a graph showing relationships between optical densities and heating time in the first embodiment.
FIG. 20 is a table in which image densities on a print medium and on a textile printing-target medium, and a sublimation transfer efficiency are shown for each of textile printing toners of respective colors and for each of heating temperatures.

FIG. 18 shows relationships between the measurement results of the magenta and cyan optical densities (the M value and the C value, OD Value in FIG. 18) of a transfer image of the comparative example and the heating time. FIG. 19 shows a relationship between the measurement results of the magenta and cyan optical densities (the M value and the C value) of a transfer image of the first embodiment and the heating time.

In each of FIGS. 18 and 19, the vertical axis indicates the optical density (OD value) and the horizontal axis indicates the heating time (in seconds). Further, the plot in triangles shows the magenta optical density (M value) and the plot in squares shows the cyan optical density (C value).

In both FIGS. 18 and 19, the magenta optical density is high when the heating time is short, and decreases as the heating time increases. On the other hand, the cyan optical density is low when the heating time is short, and increases as the heating time increases. This is because the migration of the textile printing magenta dye to the textile printing-target medium is fast and that of the textile printing cyan dye is slow.

Comparing the comparative example (FIG. 18) with the first embodiment (FIG. 19), it is clear that the decrease in the magenta optical density is suppressed more in the first embodiment than in the comparative example. In particular, when a heating time T during which the cyan optical density rises to a sufficient density is set to 90 seconds, the magenta optical density at the time point of 90 seconds is higher in the first embodiment than in the comparative example.

This is because, as described with reference to FIGS. 12A-12D, the migration of the textile printing magenta dye to the textile printing-target medium L is delayed by the textile printing cyan dye existing on the side close the textile printing-target medium L, and, as a result, the decrease in the magenta optical density on the surface of the textile printing-target medium L is suppressed.

Next, sublimation rates of the textile printing toners are described. In order to evaluate the sublimation rates of the textile printing toners of the respective colors to the textile printing-target medium L, the print pattern illustrated in FIG. 17 was printed using the image forming apparatus 1 (the color printer "C841" manufactured by Oki Data Corporation).

In the image forming apparatus 1, setting for the development voltages respectively applied to the development rollers 14 and adjustment for amounts of the textile printing toners on the print medium P were performed such that the magenta (M), yellow (Y), black (Bk) and cyan (C) print image densities (based on the above-described spectrodensitometer) were all 1.40.

Thereafter, an image was textile-printed on a polyester fabric T-shirt (unbranded product) by using the hot press machine 4 illustrated in FIG. 4, keeping the heating time constant at 60 seconds, and changing the heating temperature among 100° C., 120° C., 140° C., 160° C., and 180° C. The applied pressured was 61.9 g/cm2 as described above.

Thereafter, in the image textile-printed on the textile printing-target medium L, densities at A1, A2, A3, and A4 illustrated in FIG. 17 were measured, and sublimation transfer efficiencies of the textile printing dyes of the respective colors were determined. The sublimation transfer efficiencies (%) were calculated according to the following formula (1):

$$\text{Sublimation transfer efficiency} = ((\text{optical density of image on the textile printing-target medium } L)/(\text{optical density of image on the print medium } P)) \times 100 \quad (1)$$

FIG. 20 is a table in which the optical density of the image on the print medium P (1. OD Value On Print Medium P in FIG. 20), the optical density of the image on the textile printing-target medium L (2. OD Value On Textile Printing-Target Medium L), and the sublimation transfer efficiency (3. Sublimation. Transfer Efficiency (%)) are shown for each of the textile printing dyes of the respective colors and for each of the heating temperatures.

FIG. 21 is a graph in which the relationship between the sublimation transfer efficiency and the heating temperature is shown for each of the textile printing dyes of the respective colors. The vertical axis shows the sublimation transfer efficiency, and the horizontal axis shows the heating temperature.

In FIG. 21, the sublimation transfer efficiency of each of the textile printing dyes of the respective colors was approximated using a linear function (y=ax+b), and the slope a of the linear function was determined. It can be said that the larger the slope a, the easier for the textile printing toner to dye the textile printing-target medium L, that is, the higher the sublimability of the textile printing toner. Conversely, it can be said that the smaller the slope a, the more difficult for the textile printing toner to dye the textile printing-target medium L, that is, the lower the sublimability. Therefore, the slope a is referred to as a sublimation rate (or a temperature change rate of the sublimation transfer efficiency).

From the results of FIG. 21, the sublimation rate of the textile printing magenta toner is 0.8582 (1/° C.) and the sublimation rate of the textile printing yellow toner is 0.8492 (1/° C.). The sublimation rate of the textile printing black toner is 0.6401 (1/° C.), and the sublimation rate of the textile printing cyan toner is 0.5384 (1/° C.). That is, a descending order of the sublimation rates is an order of magenta, yellow, black and cyan.

FIG. 22 is a table in which the weight reduction start temperature and the sublimation rate determined as described above are shown for each of the colors. As shown in FIG. 22, the ascending order of the weight reduction start temperatures and the descending order of the sublimation rates are the same order, and both are the order of magenta, yellow, black and cyan.

That is, it can be said that the lower the weight reduction start temperature and the faster the sublimation rate of a textile printing toner, the higher the sublimability of the textile printing dye contained in the textile printing toner. Conversely, it can be said that the higher the weight reduction start temperature and the slower the sublimation rate of a textile printing toner, the lower the sublimability of the textile printing dye contained in the textile printing toner.

From FIG. 22, it is observed that a difference between weight reduction start temperatures of magenta (337.7° C.) and yellow (348.0° C.) was 10.3° C., a difference between weight reduction start temperatures of black (357.8° C.) and yellow (348.0° C.) was 9.8° C., and a difference between weight reduction start temperatures between cyan (359.3° C.) and black (357.8° C.) was 1.5° C. When selecting first and second textile printing materials from these colors, the invention may be exercised under a condition where the difference between weight reduction start temperatures of the first and second textile printing materials is at least 1.5° C. or more. The difference may be 5 or more. The difference between the first and second textile printing materials may be at around 10° C. or less than 10.3° C.

Effect of Embodiment

As described above, the image forming apparatus 1 of the first embodiment includes: the process unit 10M (first image forming part) that has the textile printing magenta toner (first textile printing coloring material) containing the textile printing magenta dye, and forms a magenta image (first image); and the process unit 10C (second image forming part) that has the textile printing cyan toner (second textile printing coloring material) containing the textile printing cyan dye having a lower sublimability than the textile printing magenta dye, and forms a cyan image (second image). When the magenta image and the cyan image are superimposingly formed on the print medium P, the cyan image is formed on the magenta image. Therefore, when the images are textile-printed onto the textile printing-target medium L, the cyan image is positioned on the side close to the textile printing-target medium L. As a result, the migration of the textile printing magenta dye having a high sublimability to the textile printing-target medium L is delayed by the textile printing cyan dye having a low sublimability. Therefore, decreases in the densities the respective colors on the textile printing-target medium L can be suppressed, and the color reproducibility can be improved.

The same applies to a case where a magenta image and a yellow image are superimposingly formed on the print medium P, or a case where a yellow image and a cyan image are superimposingly formed on the print medium P.

Further, in some cases, the textile printing black toner is combined with a textile printing toner of another color for a purpose of adjusting a color of an image. Also in this case, when an image formed using a textile printing toner containing a textile printing dye having a lower sublimability than the textile printing black dye (for example, in the case of a black image and a magenta image, the black image) is formed in an upper layer on the print medium P, as described above, the color reproducibility during textile printing can be improved.

In particular, in the image forming apparatus 1 of the first embodiment, the process units 10M, 10Y, 10Bk, 10C are arranged in the descending order of the sublimabilities (the ascending order of the weight reduction start temperatures and the descending order of the sublimation rates) along the carrying direction of the print medium P. Therefore, for any combination of multiple colors, a textile printing toner having a lower sublimability is positioned in an upper layer on the print medium P. Therefore, decreases in the densities the respective colors on the textile printing-target medium can be suppressed, and the color reproducibility can be improved.

Here, the case where textile printing toners of two colors (for example, the textile printing magenta toner and the textile printing cyan toner) are combined has been described. However, it is also possible that textile printing toners of three colors are combined.

For example, in the example illustrated in FIG. 23, a magenta image 20M, a yellow image 20Y and a cyan image 20C are sequentially formed on the print medium P using the textile printing magenta toner, the textile printing yellow toner, and the textile printing cyan toner. The cyan image 20C is positioned in an uppermost layer (uppermost portion).

Figure 24:
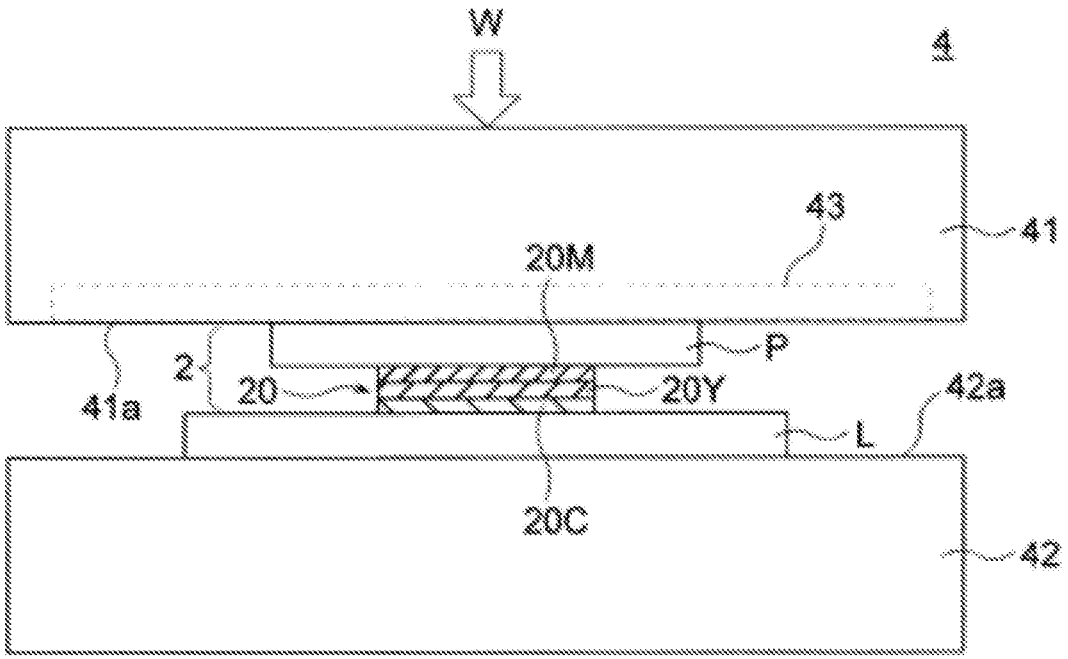
FIG. 24 is a schematic diagram illustrating another example of a textile printing process.

In a textile printing process, as illustrated in FIG. 24, the cyan image 20C, the yellow image 20Y and the magenta image 20M are sequentially transferred to the textile printing-target medium L, and a process black (PB) image is obtained. The cyan image 20C is positioned closest to the textile printing-target medium L, the yellow image 20Y is positioned on the cyan image 20C, and the magenta image 20M is positioned on the yellow image 20Y.

As described above, the textile printing yellow dye (third textile printing dye: third coloring agent) has a lower sublimability than the textile printing magenta dye and a higher sublimability than the textile printing cyan dye. Since the cyan image 20C is positioned closest to the textile printing-target medium L, the textile printing cyan dye delays migration of the textile printing magenta dye and the textile printing yellow dye to the inside of the textile printing-target medium L. Therefore, decreases in the densities the respective colors on surface of the textile printing-target medium L can be suppressed, and the color reproducibility can be improved.

That is, when an image is formed using textile printing toners of three or more colors, an image formed using a textile printing toner having the lowest sublimability may be formed in an uppermost layer on the print medium P.

First Modified Embodiment

Figure 25:
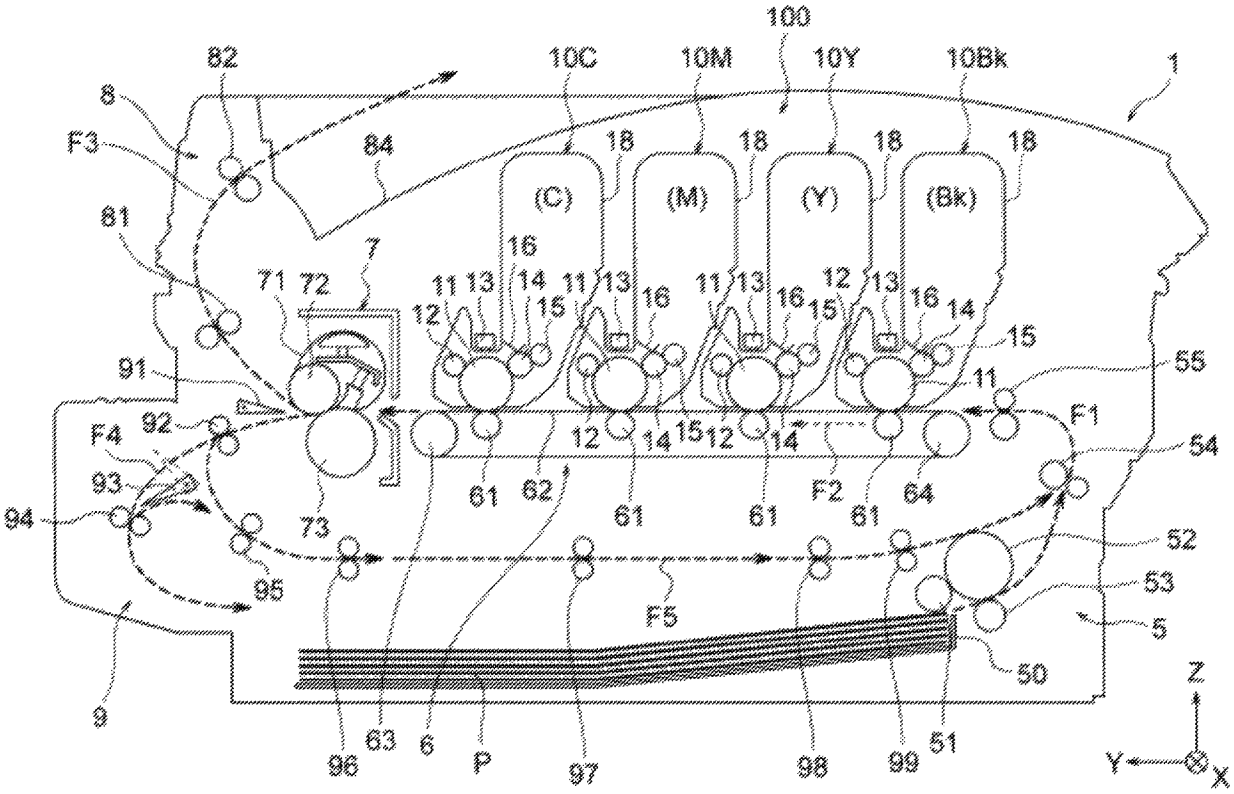
FIG. 25 illustrates an image forming apparatus of a first modified embodiment.

FIG. 25 illustrates an image forming apparatus 1A of a first modified embodiment of the first embodiment. In the first modified embodiment, the black, yellow, magenta and cyan process units 10Bk, 10Y, 10M, 10C are sequentially arranged along the carrying direction of the print medium P.

The cyan process unit 10C having the lowest sublimability is positioned most downstream among the process units 10Bk, 10Y, 10M, 10C. Therefore, when an image (for example, a blue or green image or the like) is formed by combining the textile printing cyan toner and a textile printing toner of another color, a cyan image is formed in an uppermost layer on the print medium P. Therefore, decreases in the densities the respective colors on surface of the textile printing-target medium L can be suppressed, and the color reproducibility can be improved.

On the other hand, when an image is formed without using the textile printing cyan toner, for example, when a red image is formed using the textile printing magenta toner and the textile printing yellow toner, it is possible that, after a magenta image is formed on the print medium P, a yellow image is superimposingly formed on the magenta image by the above-described superimposed printing using the re-carrying mechanism 9 (the print mode in which images are superimposingly formed on the same surface without inverting the print medium P).

In the image forming apparatus 1A of the first modified embodiment, the black process unit 10Bk is arranged most upstream. Since the black process unit 10Bk is frequently used, a separation mechanism may be provided in which the process units 10Y, 10M, 10C other than the black process unit 10Bk are separated from the transfer unit 6 during black-and-white printing. As in this first modified embodiment, when the black process unit 10Bk is positioned most upstream (or most downstream), there is a merit that the separation mechanism can be easily configured.

Second Modified Embodiment

Figure 26:
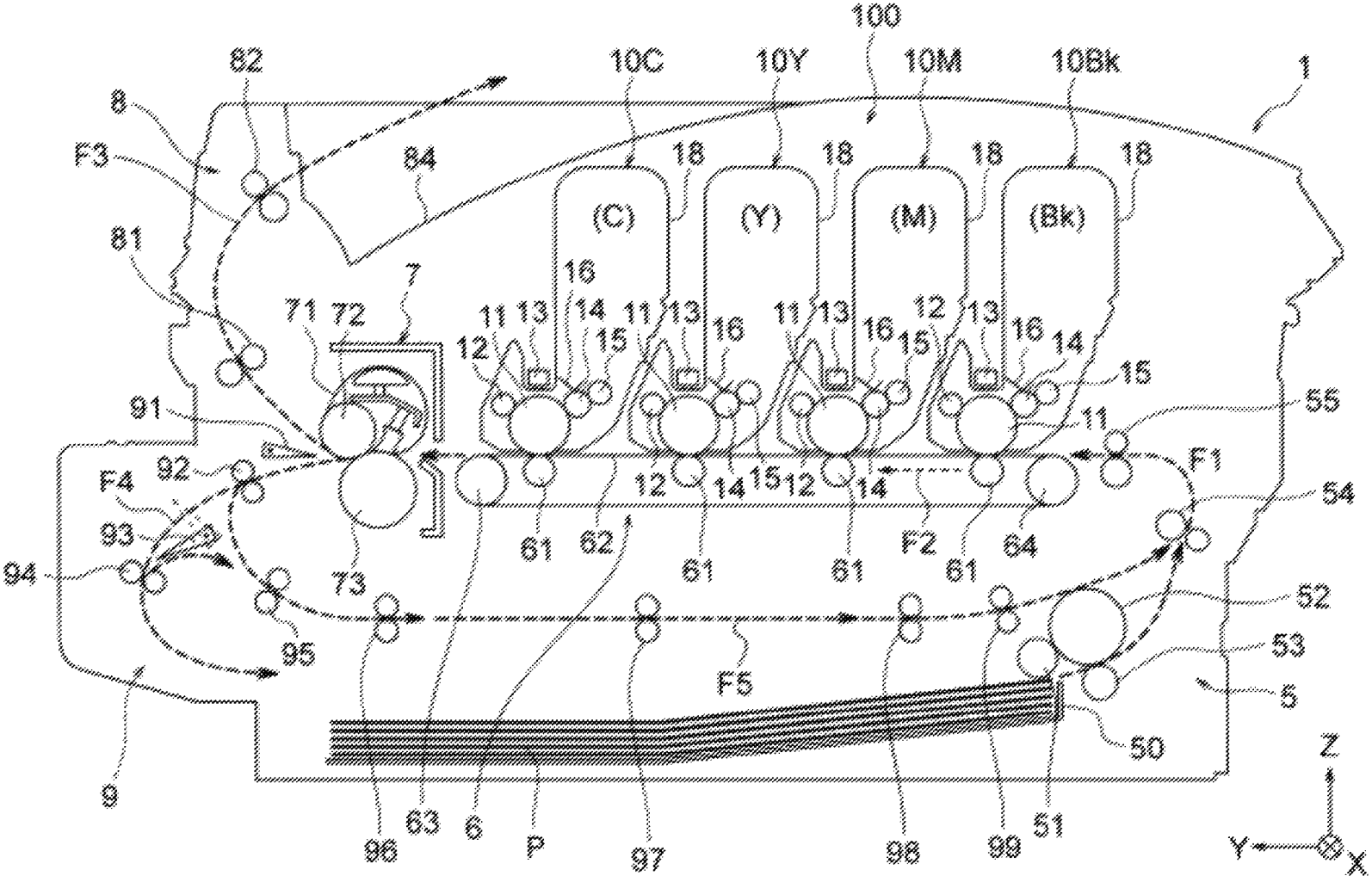
FIG. 26 illustrates an image forming apparatus of a second modified embodiment.

FIG. 26 illustrates an image forming apparatus 1B of a second modified embodiment of the first embodiment. In the second modified embodiment, the black, magenta, yellow and cyan process units 10Bk, 10M, 10Y, 10C are sequentially arranged along the carrying direction of the print medium P.

In the image forming apparatus 1B of the second modified embodiment, similarly to the image forming apparatus 1 of the first embodiment, the cyan process unit 10C having the lowest sublimability is arranged most downstream among the process units 10Bk, 10Y, 10M, 10C. Therefore, when an image (for example, a blue or green image or the like) is formed by combining the textile printing cyan toner and a textile printing toner of another color, a cyan image is formed in an uppermost layer. Therefore, decreases in the densities the respective colors on surface of the textile printing-target medium L can be suppressed, and the color reproducibility can be improved.

Further, in the image forming apparatus 1B of this second modified embodiment, except for the black process unit 10Bk, the magenta, yellow and cyan process units 10M, 10Y, 10C are arranged in a descending order of the sublimabilities. Therefore, when two or more of the textile printing magenta toner, the textile printing yellow toner and the textile printing cyan toner are combined, a textile printing toner having the lowest sublimability is positioned in an uppermost layer on the print medium P. Therefore, decreases in the densities the respective colors on surface of the textile printing-target medium L can be suppressed, and the color reproducibility can be improved.

In the above-described first embodiment and modified embodiments, the textile printing toners are described. However, it is also possible to use inks containing textile printing dyes, textile printing pigments, or thermally diffusible dyes. That is, it is also possible that an image formed using inks (coloring materials) containing textile printing dyes or textile printing pigments on the print medium P is textile-printed on a textile printing-target medium. In this invention, such toners and inks discussed above are referred as textile printing coloring materials.

Third Modified Embodiment

Figure 27:
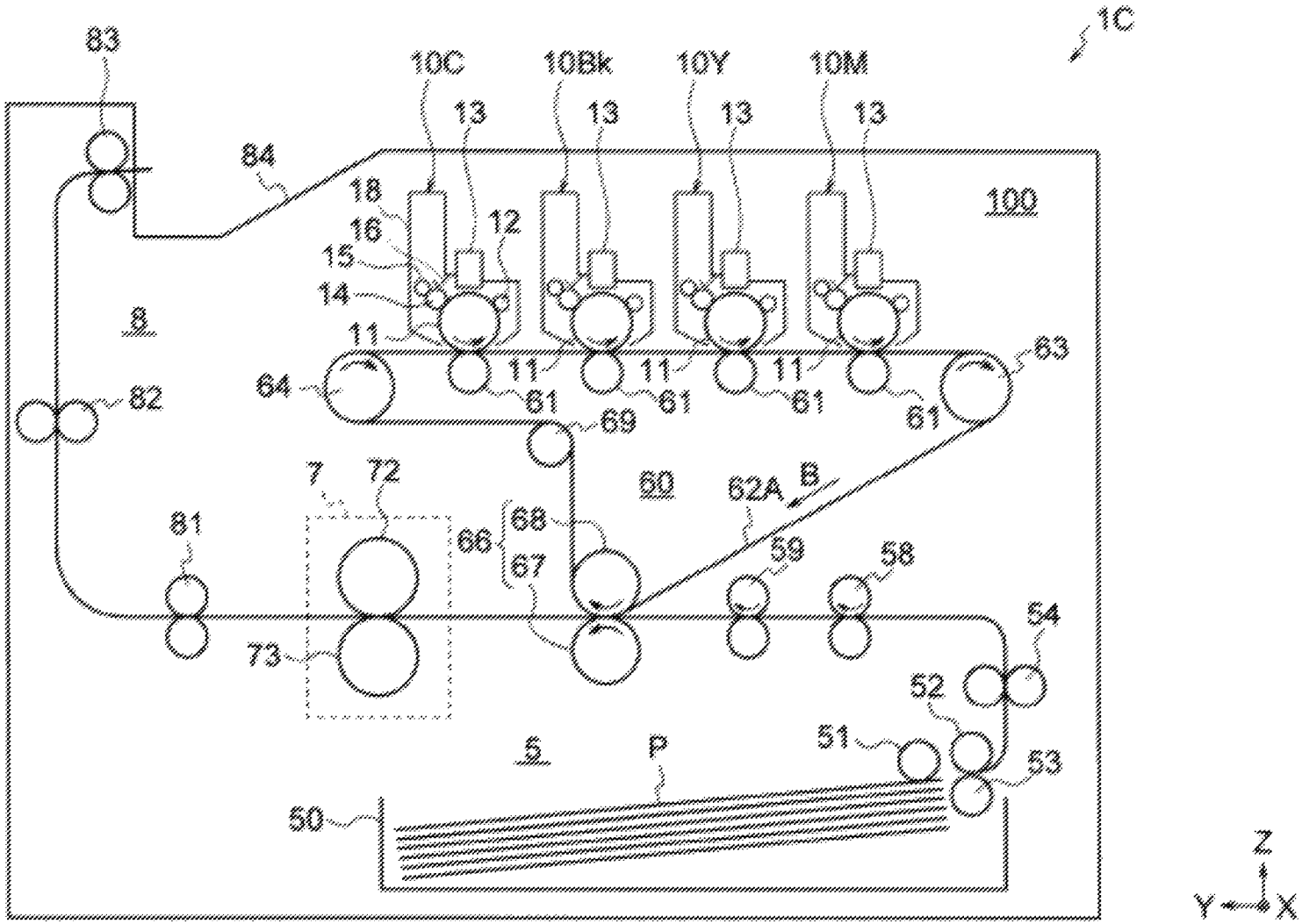
FIG. 27 illustrates an image forming apparatus of a third modified embodiment.

FIG. 27 illustrates an image forming apparatus 1C of a third modified embodiment of the first embodiment. In the above-described first embodiment, the direct transfer type image forming apparatus 1 (FIG. 1) in which the toner images on the photosensitive drums 11 are directly transferred to the print medium P. In contrast, the image forming apparatus 1C of the third modified embodiment is of an intermediate transfer type in which an intermediate transfer belt 62A as an intermediate transfer body is used to transfer an image to the print medium P.

The image forming apparatus 1C includes a medium supply part 5 that supplies the print medium P, an image forming part 100 that forms a toner image, an intermediate transfer unit 6A that transfers the toner image formed by the image forming part 100 to the print medium P via an intermediate transfer belt 62A, a fuser device 7 that fuses the toner image onto the print medium P, and a medium ejection part 8 that ejects the print medium P.

The medium supply part 5 includes the sheet feeding tray 50, the pickup roller 51, the feed roller 52, the retard roller 53, and the registration roller pair 54, which are described in the first embodiment. Further, the medium supply part 5 includes two carrying roller pairs 58, 59 in place of the one carrying roller pair 55 described in the first embodiment.

The image forming part 100 has four process units 10C, 10Bk, 10Y, 10M as image forming units that respectively form toner images using cyan, black, yellow and magenta textile printing toners (textile printing coloring materials: developers). The process units 10C, 10Bk, 10Y, 10M are arranged in this order along a movement direction of the intermediate transfer belt 62A (from left to right in FIG. 27).

Individual configurations of the process units 10C, 10Bk, 10Y, 10M are as described in the first embodiment.

The intermediate transfer unit 6A has the endless intermediate transfer belt 62A. The intermediate transfer unit 6A further has a belt drive roller 63, an idle roller 64, a secondary transfer backup roller 68 and a guide roller 69, around which the intermediate transfer belt 62A is stretched. The belt drive roller 63 and the idle roller 64 are as described in the first embodiment.

On an outer side of the intermediate transfer belt 62A, a secondary transfer roller 67 is provided so as to sandwich the intermediate transfer belt 62A with the secondary transfer backup roller 68. A secondary transfer part 66 is formed by the secondary transfer roller 67 and the secondary transfer backup roller 68.

The fuser device 7 is arranged on a downstream side of the secondary transfer part 66 in the carrying direction of the print medium P. The fuser device 7 has a fuser roller 72 and a pressing roller 73 pressed against the fuser roller 72. The fuser roller 72 and the pressing roller 73 apply heat and pressure to the toner image transferred to the print medium P and fuse the toner image onto the print medium P. The fuser belt 71 illustrated in FIG. 1 may also be provided.

The medium ejection part 8 is arranged on a downstream side of the fuser device 7 in the carrying direction of the print medium P, and includes ejection roller pairs 81, 82, 83 as three roller pairs. The ejection roller pairs 81, 82, 83 carry the print medium P carried out from the fuser device 7 along an ejection carrying path F3 and eject the print medium P to outside of the image forming apparatus 1C. A stacker part 84 in which ejected mediums are stacked is provided at an upper portion of the image forming apparatus 1C.

In the image forming apparatus 1C, when a print operation is started, the pickup roller 51 rotates to feed out the print medium P from the sheet feeding tray 50, and the feed roller 52 and the retard roller 53 rotate to feed the print medium P to a carrying path. Further, the registration roller pair 54 starts rotating at a predetermined timing to carry the print medium P while correcting a skew of the print medium P, and the carrying roller pairs 58, 59 carry the print medium P toward the secondary transfer part 66.

Further, due to the rotation of the belt drive roller 63, the intermediate transfer belt 62A moves in a direction indicated by an arrow B in the drawing. In the process units 10, toner images of the respective colors are formed. The toner images formed on the photosensitive drums 11 are primary-transferred to the intermediate transfer belt 62A by the transfer rollers 61 (primary transfer rollers).

The toner image on the intermediate transfer belt 62A and the print medium P carried by the carrying roller pairs 58, 59 arrive at the secondary transfer part 66 at the same time. A secondary transfer voltage is applied to the secondary transfer part 66, and the toner image on the intermediate transfer belt 62A is secondary-transferred to the print medium P.

The print medium P to which the toner image has been secondary-transferred in the secondary transfer part 66 is carried to the fuser device 7. In the fuser device 7, the print medium P is pressed and heated in a fusing nip between the fuser roller 72 and pressing roller 73, and the toner image is fused onto the print medium P.

The print medium P onto which the toner image has been fused is ejected to the outside of the image forming apparatus 1C by the ejection roller pairs 81, 82, 83, and is stacked on the stacker part 84. As a result, the formation of the color image on the print medium P is completed.

The process units 10C, 10Bk, 10Y, 10M of the image forming apparatus 1C are arranged in an ascending order of the sublimabilities of the textile printing dyes in the movement direction of the intermediate transfer belt 62A. Therefore, for example, when a magenta image and a cyan image are superimposingly formed, on the intermediate transfer belt 62A, the cyan image of a textile printing toner having a lower sublimability is formed under the magenta image.

Therefore, when the toner image is transferred to the print medium P in the secondary transfer part 66, the cyan image of the textile printing toner having a lower sublimability is formed on the magenta image. As a result, a textile printing process can be performed in the same manner as in the first embodiment. The same applies to a case where a magenta image and a yellow image are superimposingly formed, or a case where a yellow image and a cyan image are superimposingly formed.

Here, the process units 10C, 10Bk, 10Y, 10M are arranged in an ascending order of the sublimabilities of the textile printing dyes in the movement direction of the intermediate transfer belt 62A. However, as in the first modified embodiment (FIG. 25) and the second modified embodiment (FIG. 26) described above, it is also possible that the black process unit 10Bk is arranged at an end in the arrangement direction.

In the image forming apparatus 1C of this third modified embodiment, when a magenta image and a cyan image are superimposingly formed, the cyan image is formed under the magenta image on the intermediate transfer belt 62A. Therefore, when the images are transferred from intermediate transfer belt 62A to the print medium P, the cyan image is positioned on the magenta image, and, when the images are textile-printed on the textile printing-target medium L, the cyan image is positioned on the side close to the textile printing-target medium L. As a result, similar to the first embodiment, decreases in the densities the respective colors on the textile printing-target medium L can be suppressed, and the color reproducibility can be improved.

In the above, the embodiment and modified embodiments of the present invention are described. However, the present invention is not limited to the above-described embodiments, and various modifications or alterations are possible.

The present invention can be applied to an image forming apparatus (for example, a copying machine, a facsimile, a printer, a multifunction peripheral, or the like) that forms an image on a medium using an electrophotographic method.

What is claimed is:

1. An image forming apparatus, comprising:

a first image forming part that has a first textile printing coloring material and forms a first image with the first textile printing coloring material wherein the first textile printing coloring material contains a first coloring agent that has a first sublimability; and a second image forming part that has a second textile printing coloring material and forms a second image with the second textile printing coloring material wherein the second textile printing coloring material contains a second coloring agent that has a second sublimability, which is lower than the first sublimability of the first coloring agent, wherein when the first image and the second image are superimposingly formed on a print medium, the second image is superimposingly formed over the first image.

2. The image forming apparatus according to claim 1, wherein a weight reduction start temperature of the second textile printing coloring material during heating is higher than a weight reduction start temperature of the first textile printing coloring material.

3. The image forming apparatus according to claim 2, wherein a difference, which is between the weight reduction start temperature of the second textile printing coloring material and the weight reduction start temperature of the first textile printing coloring material, is 1.5° C. or more.

4. The image forming apparatus according to claim 2, wherein the heating is performed at a temperature rising rate of 20° C./second in a nitrogen atmosphere in a temperature range of 25-600° C.

5. The image forming apparatus according to claim 1, wherein, when a ratio of a density after transferring from the print medium to a textile printing-target medium to a density on the print medium is a sublimation transfer efficiency, and a change rate of the sublimation transfer efficiency with respect to a temperature change is a sublimation rate, a sublimation rate of the second textile printing coloring material is lower than a sublimation rate of the first textile printing coloring material.

6. The image forming apparatus according to claim 1, further comprising:

a carrying mechanism that carries the print medium in a carrying direction, wherein the second image forming part is arranged on a downstream side of the first image forming part in the carrying direction of the print medium.

7. The image forming apparatus according to claim 1, further comprising:

a third image forming part that has a third textile printing coloring material and forms a third image with a third textile printing coloring material wherein the third textile printing coloring material contains a third coloring agent that has a third sublimability, which is lower than the first sublimability of the first coloring material and higher than the second sublimability of the second coloring material.

8. The image forming apparatus according to claim 7, wherein when the first image, the second image and the third image are superimposingly laminated on the print medium, the third image forming part forms the third image between the first image and the second image.

9. The image forming apparatus according to claim 1, further comprising:

multiple image forming parts, which include the first image forming part and the second image forming part, each of the multiple image forming parts having a textile printing coloring material and forms an image with the textile printing coloring material wherein the textile printing coloring material contains a coloring material that has a sublimability, wherein the coloring materials contained in the textile printing coloring materials are different from each other, the second textile printing coloring material has the lowest sublimability among all the textile printing coloring materials of the multiple image forming parts, and the second image forming part forms the second image in an uppermost portion of the images respectively formed by the multiple image forming parts.

10. The image forming apparatus according to claim 9, further comprising:

a carrying mechanism that carries the print medium in a carrying direction, wherein the second image forming part is arranged on a most downstream side of the multiple image forming parts in the carrying direction of the print medium.

11. The image forming apparatus according to claim 10, wherein the multiple image forming parts are arranged in a descending order of the sublimabilities of textile printing coloring materials in the carrying direction of the print medium such that one sublimability of one image forming part is lower than that of another image forming part positioned next to the one image forming part at an upstream side in the carrying direction.

12. The image forming apparatus according to claim 1, wherein the first textile printing coloring material is a developer containing a first textile printing dye as the first coloring agent, and the second textile printing coloring material is a developer containing a second textile printing dye as the second coloring agent.

13. The image forming apparatus according to claim 1, wherein the first image forming part and the second image forming part respectively form the first image and the second image using an electrophotographic method.

14. The image forming apparatus according to claim 1, wherein the first textile printing coloring material and the second textile printing coloring material sublimate by being heated and pressed.

15. The image forming apparatus according to claim 1, further comprising:

a transfer member that is arranged opposing the first image forming part and the second image forming part to directly transfer the first image and the second image to the print medium respectively from the first image forming part and the second forming part, wherein the second forming part is positioned at a downstream side from the first forming part in the carrying direction.

16. The image forming apparatus according to claim 1, further comprising:

an intermediate transfer body that is arranged opposing the first image forming part and the second image forming part such that the first image is formed by the first forming part on the intermediate transfer body and the second image is formed by the second forming part on the intermediate transfer body, next, the first and second images are simultaneously transferred on the print medium from the intermediate transfer body, wherein the intermediate transfer body moves in a transferring direction (B) while transferring the first and second images, the second forming part is positioned at an upstream side from the first forming part in the transferring direction of the intermediate transfer body.

17. An image forming method, comprising:

a process in which a first image is formed on a print medium using a first textile printing coloring material containing a first coloring agent; and a process in which, when a second image is superimposingly formed on the first image, the second image is formed on the first image using a second textile printing coloring material containing a second coloring agent having a sublimability lower than a sublimability of the first coloring agent.

18. The image forming method according to claim 17, wherein a weight reduction start temperature of the second textile printing coloring material during heating is higher than a weight reduction start temperature of the first textile printing coloring material.

19. The image forming method according to claim 17, wherein when a ratio of a density after transferring from the print medium to a textile printing-target medium to a density on the print medium is a sublimation transfer efficiency, and a change rate of the sublimation transfer efficiency with respect to a temperature change is a sublimation rate, a sublimation rate of the second textile printing coloring material is lower than a sublimation rate of the first textile printing coloring material.

20. A method for producing a coloring medium, comprising:

a process in which a first image is formed on a print medium using a first textile printing coloring material containing a first coloring agent; and a process in which, when a second image is superimposingly formed on the first image, the second image is formed on the first image using a second textile printing coloring material containing a second coloring agent having a sublimability lower than a sublimability of the first coloring agent.

* * * * *